US011344066B2

(12) United States Patent
Rado

(10) Patent No.: US 11,344,066 B2
(45) **Date of Patent: *May 31, 2022**

(54) PERSONAL VAPORIZER AND METHOD FOR FILLING SAME

(71) Applicant: Vaporous Technologies, Inc., Torrance, CA (US)

(72) Inventor: J. Christian Rado, Torrance, CA (US)

(73) Assignee: Vaporous Technologies, Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/138,417

(22) Filed: Dec. 30, 2020

(65) Prior Publication Data

US 2021/0112873 A1 Apr. 22, 2021

Related U.S. Application Data

(63) Continuation-in-part of application No. 16/875,942, filed on May 15, 2020, now Pat. No. 11,147,313.

(60) Provisional application No. 62/852,733, filed on May 24, 2019, provisional application No. 62/848,321, filed on May 15, 2019.

(51) Int. Cl.

| | |
|---|---|
| ***A24F 40/485*** | (2020.01) |
| ***B67D 7/36*** | (2010.01) |
| ***A24F 40/42*** | (2020.01) |
| ***A24F 40/10*** | (2020.01) |

(52) U.S. Cl.

CPC ..... *A24F 40/485* (2020.01); *A24F 40/10* (2020.01); *A24F 40/42* (2020.01); *B67D 7/362* (2013.01)

(58) Field of Classification Search

CPC .... A24F 15/015; A24F 40/40; A24F 40/4042; A24F 40/48; B67D 7/0288

See application file for complete search history.

(56) References Cited

U.S. PATENT DOCUMENTS

| | | | |
|---|---|---|---|
| 2,104,266 | A | 1/1938 | McCormick |
| 3,200,819 | A | 8/1965 | Gilbert |
| 4,947,874 | A | 8/1990 | Brooks |
| 7,832,410 | B2 | 11/2010 | Hon |
| 8,156,944 | B2 | 4/2012 | Han |
| 8,365,742 | B2 | 2/2013 | Hon |
| 8,528,569 | B1 | 9/2013 | Newton |
| 8,794,231 | B2 | 8/2014 | Thorens |
| 9,220,303 | B2 | 12/2015 | Li |

(Continued)

OTHER PUBLICATIONS

International Search Report dated Aug. 10, 2020 for related PCT Application No. PCT/US2020/033294.

(Continued)

*Primary Examiner* — Timothy P. Kelly

(74) *Attorney, Agent, or Firm* — Klein, O'Neill & Singh, LLP

(57) ABSTRACT

A personal vaporizer has a hollow tube that extends from an atomizer through a tank for holding vaporization media. The hollow tube has a filling hole formed through a side wall thereof. To fill the tank, vaporization media can be injected into a mouthpiece and flows into the hollow tube. A divider wall in the hollow tube deflects vaporization media through the filling hole and into the tank. After the tank is filled with vaporization media, vaporizer is moved to an assembled configuration in which the filling hole is blocked.

20 Claims, 39 Drawing Sheets

(56) References Cited

U.S. PATENT DOCUMENTS

| | | | | |
|---|---|---|---|---|
| 9,254,007 | B2 | 2/2016 | Liu | |
| 9,462,832 | B2 | 10/2016 | Lord | |
| 9,750,284 | B2 | 9/2017 | Rado | |
| 9,999,253 | B2 * | 6/2018 | Li | F16K 15/14 |
| 10,004,264 | B2 | 6/2018 | Rado | |
| 10,085,481 | B2 | 10/2018 | Verleur | |
| 10,188,145 | B2 | 1/2019 | Rado | |
| 10,219,541 | B2 | 3/2019 | Rado | |
| 10,244,792 | B2 | 4/2019 | Rado | |
| 10,321,721 | B2 | 6/2019 | Rado | |
| 11,147,313 | B2 | 10/2021 | Rado | |
| 2013/0180533 | A1 * | 7/2013 | Kim | A24F 40/46 131/273 |
| 2014/0076310 | A1 | 3/2014 | Newton | |
| 2014/0355969 | A1 | 12/2014 | Stern | |
| 2015/0144148 | A1 | 5/2015 | Chen | |
| 2016/0007654 | A1 | 1/2016 | Zhu | |
| 2016/0095357 | A1 | 4/2016 | Burton | |
| 2018/0020726 | A1 | 1/2018 | Alarcon | |
| 2018/0020730 | A1 | 1/2018 | Alarcon et al. | |
| 2018/0027874 | A1 * | 2/2018 | Zhu | F22B 1/284 |
| 2018/0160737 | A1 | 6/2018 | Verleur | |
| 2018/0206554 | A1 * | 7/2018 | Jiang | A24F 40/485 |
| 2019/0031407 | A1 | 1/2019 | Biel | |
| 2020/0015524 | A1 | 1/2020 | Rado | |

OTHER PUBLICATIONS

Written Opinion dated Aug. 10, 2020 for related PCT Application No. PCT/US2020/033294.

* cited by examiner

PERSONAL VAPORIZER AND METHOD FOR FILLING SAME

CROSS-REFERENCE TO RELATED APPLICATIONS

This application is a continuation-in-part of U.S. application Ser. No. 16/875,942, which was filed May 15, 2020, which claims priority to U.S. Application Ser. Nos. 62/848,321, which was filed May 15, 2019, and 62/852,733, which was filed May 24, 2019. The entireties of each of these priority applications are hereby incorporated by reference.

BACKGROUND

The present disclosure relates to the field of personal vaporizers.

Personal vaporizers are handheld devices that vaporize a vaporizing medium such as a wax, ground herb, or fluid incorporating essential oils and/or other components. The vapor is then inhaled by its user.

In typical vaporizers, vaporizing media M is delivered onto or adjacent an atomizer, which includes a heating element such as a wire heating coil. The heating element heats the media M so that it is atomized—dispersed into very fine droplets or particles. Intake air A is drawn through the atomized vaporizing media M, and the atomized media M becomes entrained in the air A so as to form a vapor V. The vapor V is then drawn through a mouthpiece and to a user's mouth.

Some styles of personal vaporizers employ a tank for holding a vaporizing medium. An atomizer can be disposed below or near the bottom of the tank, and a vapor passage—sometimes defined by a hollow center post—extends through the tank to deliver vaporized medium from the atomizer to a mouthpiece placed atop the tank. While this general configuration has proven popular, it can be relatively difficult to fill the tank. During manufacturing, filling such a tank requires a filling nozzle—or needle—to line up with precision to fill the tank through a narrow opening. This operation may be slow and difficult, particularly in the context of mass production. It also leads to much waste, as misalignment of the filling needle—even if relatively slight—may lead to misfilling and spilling, causing waste of product, fouling of vaporizers, and also likely requiring stoppage of the manufacturing line to make adjustments.

Another problem faced by personal vaporizers is leakage of vaporization media from the tank—both through the mouthpiece and through upstream air inlets. In order to prevent or reduce such leakage, typically seals are placed between the mouthpiece and the tank and between the passageway/center post and the mouthpiece. While functional, this arrangement involves multiple parts, increasing manufacturing costs and assembly complexity. Some vaporizers include a one-way valve to block leakage toward upstream air inlets. Although effective, this structure can be improved—particularly when used in connection with vaporization media that is highly viscous or even solid when unheated.

SUMMARY

The present disclosure discloses aspects that improve personal vaporizers and the process for manufacturing them. For example, some embodiments disclose structure and a method that improves the filling process. Additional embodiments achieve sealing of the tank with a relatively simple and durable structure. Still further embodiments address and block leakage of vaporization media toward upstream air inlets.

In accordance with one embodiment, the present specification discloses a personal vaporizer, comprising a tank, a hollow tube, an atomizer, and a mouthpiece assembly. The tank is configured to contain a liquid vaporizing media. The hollow tube extends through the tank, and defines a tube lumen. A tube fill opening is formed through a side of the hollow tube. The atomizer is configured to atomize liquid vaporizing media from the tank and communicate atomized liquid vaporizing media to the tube lumen. The mouthpiece assembly comprises a sealing surface configured to engage a surface of the hollow tube. The mouthpiece assembly is configured to be slidable relative to the hollow tube so that when the mouthpiece assembly is in a first position the tube lumen is in communication with the tank via the tube fill opening, and when the mouthpiece assembly is in a second position the sealing surface blocks the fill opening.

In one such embodiment, a divider wall is disposed in the hollow tube distal of the fill opening when the mouthpiece assembly is in the first position.

In another embodiment, the mouthpiece assembly comprises a valve that is slidable within the hollow tube, the valve having a valve fill opening and comprising the divider wall distal of the valve fill opening.

In some embodiments, the valve fill opening is aligned with the tube fill opening when the mouthpiece assembly is in the first position. In further embodiments, when the mouthpiece assembly is in the second position a side wall of the valve blocks the tube fill opening.

In additional embodiments the hollow tube comprises a distal tube vapor opening and a proximal tube vapor opening formed through the side of the hollow tube.

In yet additional embodiments, the valve comprises a distal valve vapor opening and a proximal valve vapor opening, the divider wall being between the distal valve vapor opening and the proximal valve vapor opening. In some such embodiments, when the mouthpiece assembly is in the first position the distal and proximal valve vapor openings are not aligned with the distal or proximal tube vapor openings, and when the mouthpiece assembly is in the second position the distal and proximal valve vapor openings are aligned with respective ones of the distal and proximal tube vapor openings.

In further embodiments, the mouthpiece assembly additionally comprises a vapor space that is sealingly separated from the tank, and when the mouthpiece assembly is in the second position the distal and proximal valve vapor openings are in communication with the vapor space.

In yet further embodiments, the mouthpiece assembly additionally comprises a filling space that is open to the tank, and when the mouthpiece assembly is in the first position the valve fill opening is in communication with the filling space. In additional embodiments, the mouthpiece assembly comprises a sealing structure having a lumen sized to accommodate the hollow tube interposed between the sealing structure and the valve, and the filling space and vapor space are arranged in the sealing structure.

In accordance with yet another embodiment, the present specification discloses a method of filling a personal vaporizer with a liquid vaporizing media. The method comprises arranging a mouthpiece assembly onto a hollow tube of the personal vaporizer in a filling position in which a mouthpiece opening of the mouthpiece communicates with a proximal opening of the hollow tube, a filling hole formed through a side of the hollow tube is unblocked, and a divider wall is disposed in the hollow tube distal of the filling hole. The liquid vaporizing media is injected into the mouthpiece opening so that the liquid vaporizing media flows in the hollow tube and is diverted by the dividing wall through the filling hole. The liquid vaporizing media flows distally from the filling hole into a tank of the vaporizer.

Some such embodiments additionally comprise moving the mouthpiece assembly to a use position in which the filling hole is blocked from communicating with the tank.

Another embodiment additionally comprises perforating the divider wall.

Yet another embodiment additionally comprises removing the divider wall from the hollow tube.

In still another embodiment, the mouthpiece assembly comprises a valve configured to be slidable within the hollow tube and having the divider wall and a valve fill opening proximal of the valve.

In some such embodiments, the valve comprises a proximal valve vapor opening proximal of the divider wall and a distal valve vapor opening distal of the divider wall, and the hollow tube comprises a proximal tube vapor opening and a distal tube vapor opening. In such embodiments, when the mouthpiece assembly is in the use position the proximal valve vapor opening is aligned with the proximal tube vapor opening and the distal valve vapor opening is aligned with the distal tube vapor opening.

In accordance with a further embodiment the present specification provides a personal vaporizer, comprising a tank configured to contain a liquid vaporizing media, a hollow tube extending through the tank, the hollow tube defining a vapor tube portion and a filling path portion, an atomizer configured to atomize liquid vaporizing media from the tank and communicate atomized liquid vaporizing media to the vapor tube portion, and a mouthpiece having a mouthpiece opening at a proximal end. The mouthpiece is configured to be slidable over the hollow tube so that when the mouthpiece is in a first position the mouthpiece opening is in communication with the tank via the filling path portion, and when the mouthpiece is in a second position the mouthpiece opening is in communication with the vapor tube portion.

In some such embodiments a divider wall of the hollow tube separates the vapor tube portion from the filling path portion, the filling path portion being proximal of the divider wall.

In an additional embodiment the hollow tube has a proximal opening and a first side opening proximal of the divider wall, and the filling path portion is defined from the proximal opening to the first side opening. In a further embodiment the hollow tube has a second side opening distal of the divider wall, the second side opening communicating with the vapor tube portion.

In a further embodiment, when the mouthpiece is in the second position the mouthpiece blocks the first side opening. In a yet further embodiment, when the mouthpiece is in the first position the mouthpiece opening blocks the second side opening. In a still further embodiment the mouthpiece defines a filling space, and when the mouthpiece is in the first position the filling space aligns with the first side opening of the hollow tube.

In yet another embodiment, when the mouthpiece is in the second position the tank is sealed from the environment. In some such embodiments, when the mouthpiece is in the first position the mouthpiece is spaced proximally from the tank. In other such embodiments, when the mouthpiece is in the second position a portion of the mouthpiece extends into the tank.

Still another embodiment additionally comprises a mouthpiece seal interposed between the mouthpiece and the tank, the mouthpiece seal accommodating the hollow tube extending therethrough, and wherein the mouthpiece seal is configured to simultaneously contact the hollow tube, a proximal end of the tank wall and the mouthpiece so as to establish an inner seal with the hollow tube, a distal seal with the tank wall and a proximal seal with the mouthpiece. In one such embodiment, the hollow tube comprises a first locking member, and the mouthpiece seal comprises a second locking member, and wherein the first and second locking members are configured to lockingly engage one another when the mouthpiece seal is advanced over the center post to an engagement point.

In accordance with another embodiment the present specification provides a personal vaporizer, comprising a tank configured to contain a liquid vaporizing media; a mouthpiece proximal of the tank and having a mouthpiece opening at a proximal end; and an atomizer configured to atomize liquid vaporizing media from the tank and communicate atomized vaporizing media to a vapor tube, the vapor tube extending proximally from the atomizer through the tank. The mouthpiece is configured to be movable relative to the tank so that when the mouthpiece is in a first position the mouthpiece opening is in communication with the tank, and when the mouthpiece is in a second position the mouthpiece opening is in communication with the vapor tube.

In accordance with yet another embodiment, the present specification provides a method of filling a personal vaporizer with a liquid vaporizing media. The method comprises arranging a mouthpiece on a hollow tube of the personal vaporizer in a filling position in which a mouthpiece opening of the mouthpiece communicates with a tank of the personal vaporizer via a filling path portion of the hollow tube. The method further comprises injecting the liquid vaporizing media into the mouthpiece opening so that the liquid vaporizing media flows through the filling path portion and into the tank. The method still further comprises moving the mouthpiece to a use position in which the mouthpiece opening communicates with a vapor tube portion of the hollow tube.

In another embodiment, when the mouthpiece is in the use position the mouthpiece blocks the mouthpiece opening from communicating with the tank.

In yet another embodiment, when the mouthpiece is in the filling position the mouthpiece opening is blocked from communicating with the vapor tube portion of the hollow tube. A further embodiment additionally comprises moving the mouthpiece from the filling position to the use position by urging the mouthpiece distally over the hollow tube.

In one embodiment, when the mouthpiece is in the use position the tank is sealed from the environment. In some embodiments, when the mouthpiece is in the filling position the mouthpiece is spaced proximally from the tank. In other embodiments, when the mouthpiece is in the filling position a portion of the mouthpiece extends into the tank.

In accordance with still another embodiment, the present specification provides a personal vaporizer, comprising a tank configured to contain a liquid vaporizing media; an atomizer configured to atomize liquid vaporizing media from the tank and communicate atomized vaporizing media to a vapor tube, the vapor tube extending proximally from the atomizer through the tank; an elongated intake air pin distal of the atomizer and having a tubular wall defining a distal lumen and a proximal lumen separated by an inner wall, a medial air aperture being formed through the tubular wall distal of but adjacent to the inner wall and a proximal air aperture being formed through the tubular wall proximal of the inner wall, the proximal lumen of the intake air pin communicating with the atomizer; and a base housing supporting the intake air pin. A space is defined between the intake air pin and the base housing, the space being configured to trap liquid vaporizing media that may flow distally from the atomizer.

In accordance with a still further embodiment, the present specification provides a personal vaporizer, comprising a tank configured to contain a liquid vaporizing media; a center post extending through the tank, the center post defining a vapor tube portion; an atomizer configured to atomize liquid vaporizing media from the tank and communicate atomized liquid vaporizing media to the vapor tube portion; a mouthpiece having a mouthpiece opening at a proximal end, the mouthpiece opening communicating with the vapor tube; and a mouthpiece seal interposed between the mouthpiece and the tank, the mouthpiece seal accommodating the center post extending therethrough. The mouthpiece seal is configured to simultaneously contact the center post so as to establish an inner seal with the center post, a proximal end of the tank wall so as to establish a distal seal with the tank wall, and the mouthpiece so as to establish a proximal seal with the mouthpiece.

In another embodiment, the mouthpiece seal has a seal lock flange and the mouthpiece comprises a lock flange receiver configured so receive the seal lock flange so that the mouthpiece seal is attached to the mouthpiece so as to move with the mouthpiece.

In yet another embodiment, the mouthpiece is configured to be attachable to the center post so that when the mouthpiece is attached to the center post the mouthpiece seal is sandwiched between the mouthpiece and the tank wall.

In still another embodiment, the mouthpiece seal is unitarily formed.

DESCRIPTION

Figure 1:
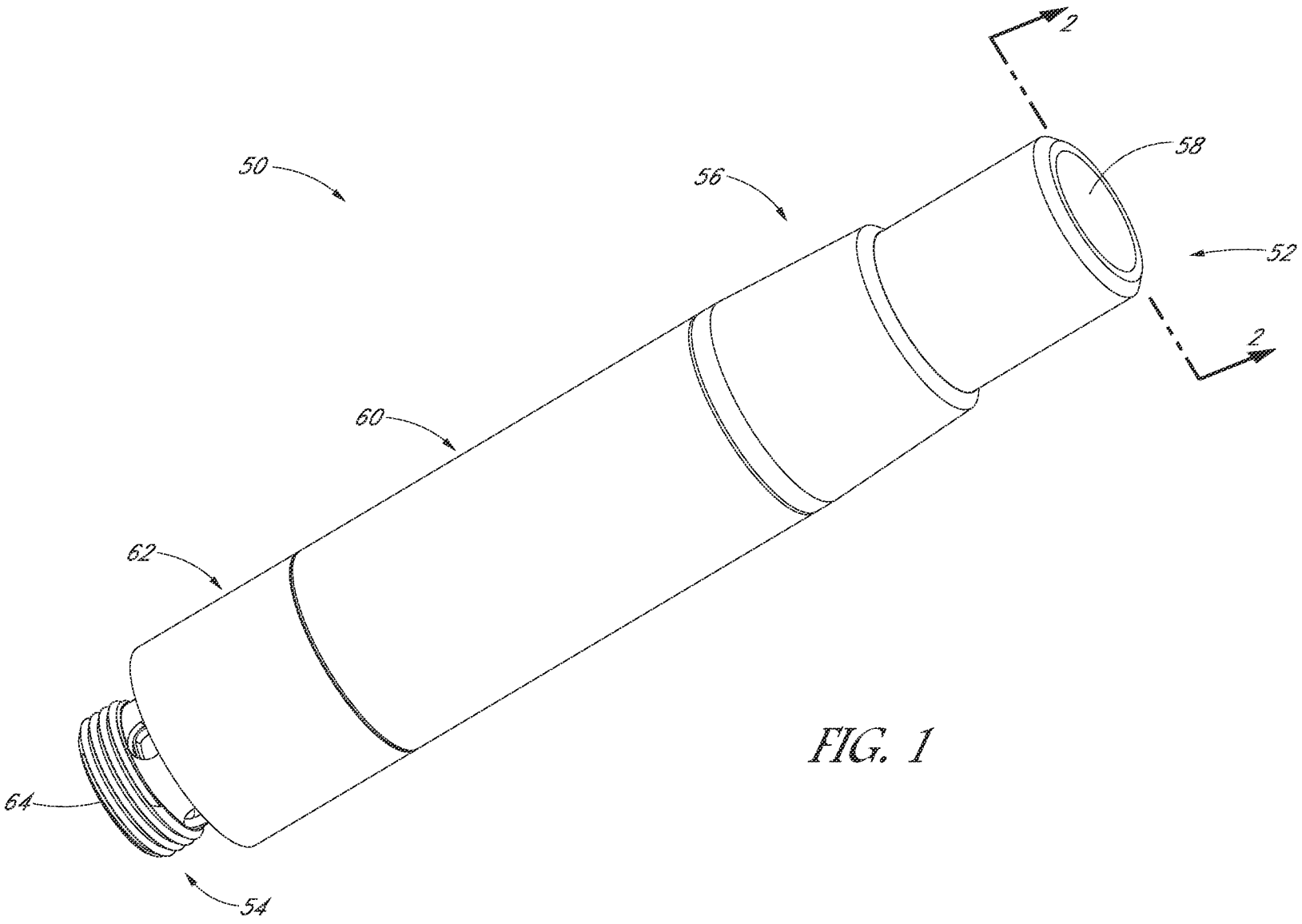
FIG. 1 is a perspective view of an embodiment of a personal vaporizer.
Figure 2:
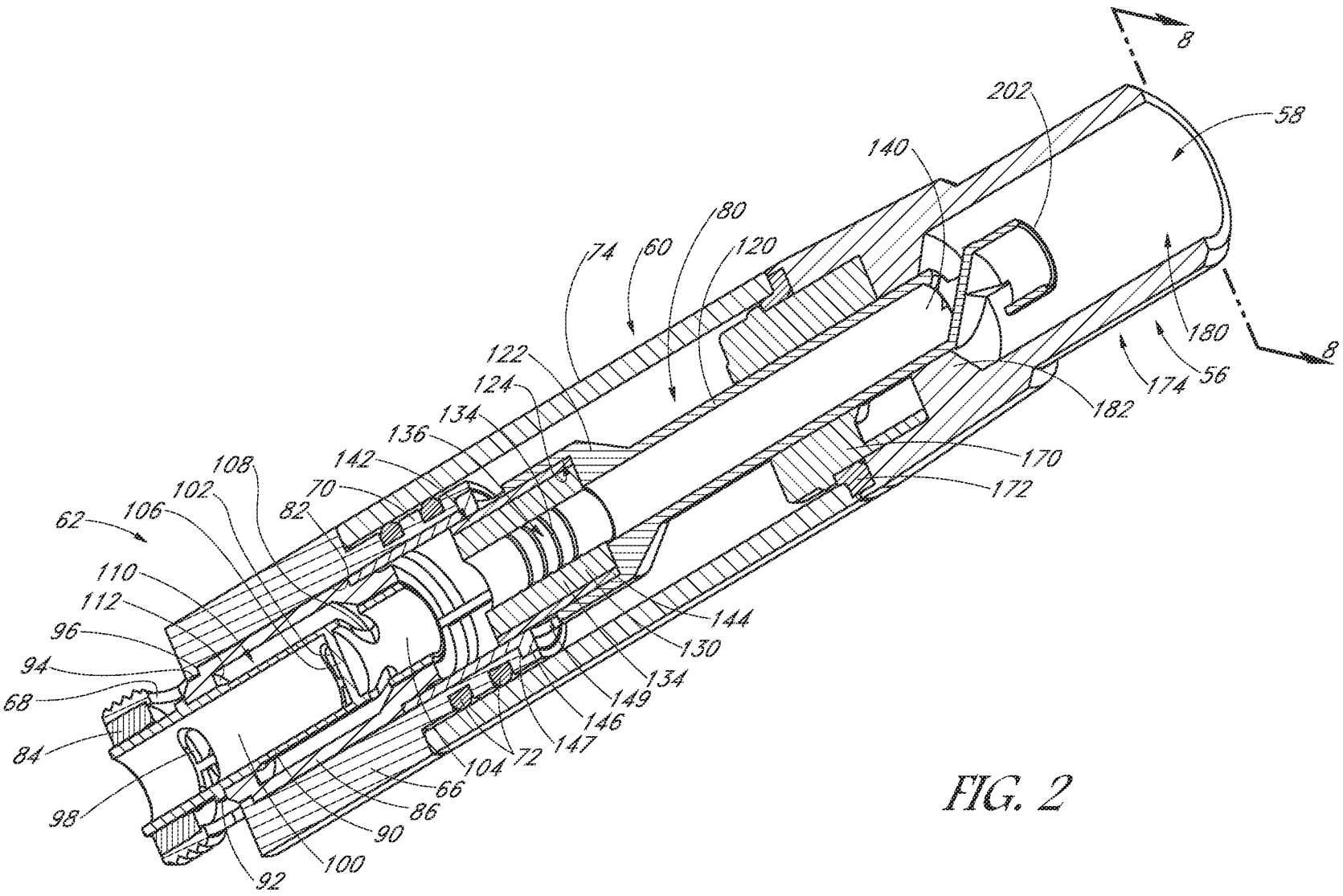
FIG. 2 is a cross-sectional view taken along line 2-2 of FIG. 1.
Figure 3:
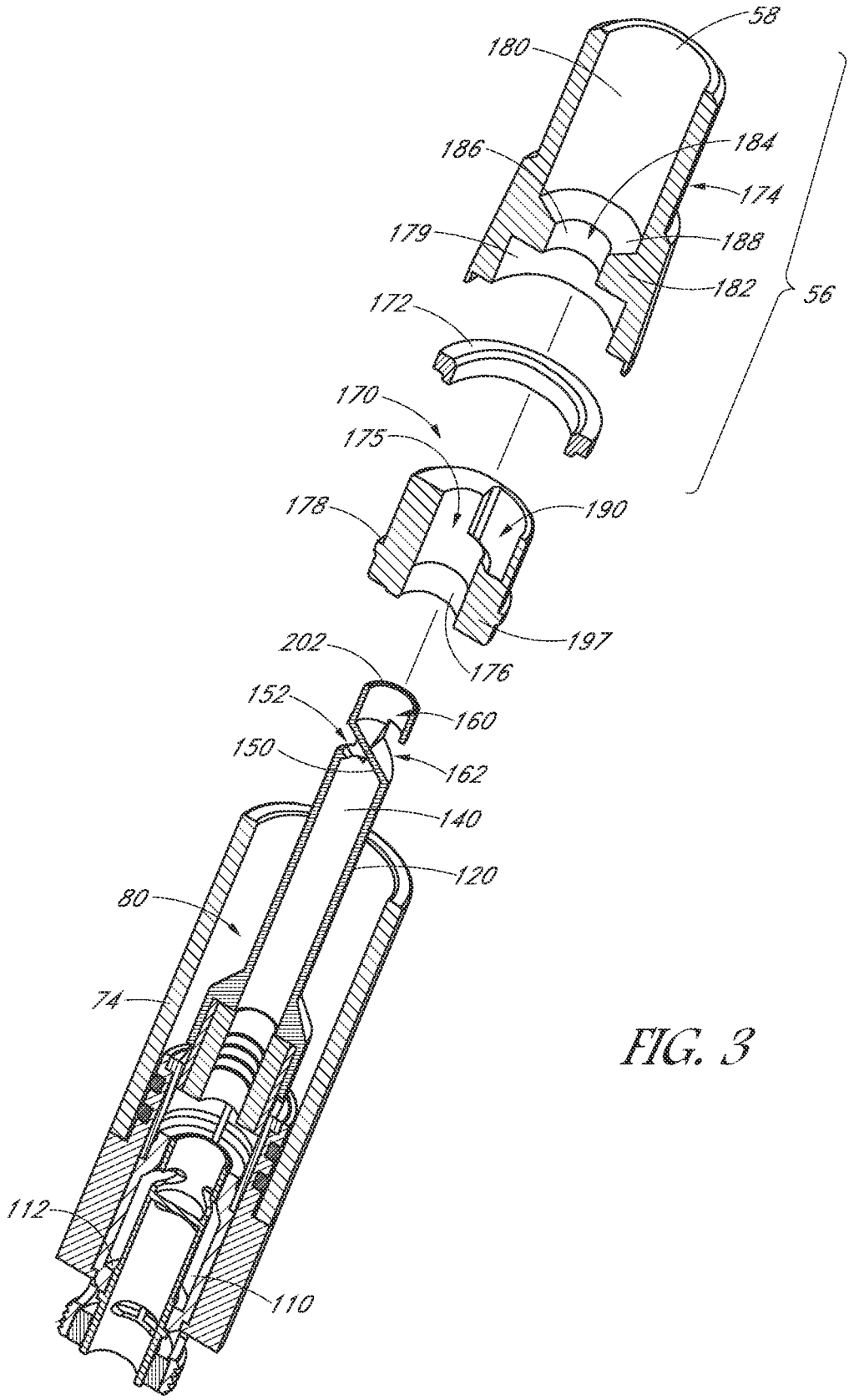
FIG. 3 is an exploded view of the arrangement of FIG. 2.

With initial reference to FIGS. 1-3, a personal vaporizer 50 extends from a proximal end 52 to a distal end 54. A mouthpiece 56 has a mouthpiece opening 58 at the proximal end 52. A tank 60 extends distally from the mouthpiece 56. A base 62 extends distally from the tank 60 to the distal end 54. In the illustrated embodiment, a battery connector 64 is disposed at the distal end 54 and is configured to connect to a conventional battery module.

Applicant's U.S. Pat. No. 10,188,145 (the "145 patent) describes embodiments of personal vaporizers, attributes of personal vaporizers, and structure that is relevant to the embodiments disclosed herein. The '145 patent also discusses interaction of vaporizer embodiments with batteries. The entirety of the '145 patent is hereby incorporated by reference herein. Applicant's US 2016/0183596 (the '596 publication) also describes structure relevant to personal vaporizers, and is also incorporated by reference herein in its entirety.

Continuing with reference to FIGS. 1-3, the base 62 comprises a base housing 66 formed of an electrically conductive material such as a metal. A distal end of the base housing 66 preferably is externally threaded so as to threadingly engage a proximal mount boss (not shown) of a typical battery. Intake air holes 68 are formed adjacent the distal end. The proximal portion of the base housing 66 comprises a mount boss portion 70 having a reduced diameter and supporting a pair of spaced-apart sealing O-rings 72. The reduced-diameter mount boss portion 70 is configured to receive an elongated tubular tank wall 74 so that an outer surface of the tank wall 74 is substantially aligned with an outer surface of the base housing 66 and the O-rings 72 establish a seal with the inner surface of the tank wall 74. A tank space 80 is defined within the tank wall 74 proximal of the base housing 66.

The base housing 66 also defines an elongated inner lumen 82 that receives an elongated conductive pin 90 therewithin. A distal insulating ring 84 is positioned between the conductive pin 90 and the distal end of the base housing 66. An elongated base insulator 86 is also positioned between the conductive pin 90 and the base housing 66, and is spaced proximally from the distal insulating ring 84. The distal insulating ring 84 and base insulator 86 electrically insulate the conductive pin 90 from the base housing 66. A distal end of the conductive pin 90 extends distally from the distal end of the base housing 66 and is configured to engage a first pole of a battery, when attached, while the distal end of the base housing 66 is configured to simultaneously engage a second, opposite, pole of the battery, when attached.

A flange 92 extends outwardly from the outer surface of the conductive pin 90, and engages the distal end of the base insulator 86, preventing the conductive pin 90 from moving proximally relative to the base insulator 86. A base housing distal flange 94 extends inwardly into the base housing lumen 82, and is complementary to a distal offset surface 96 of the base insulator 86 so as to prevent the base insulator 86 from moving distally relative to the base housing 66.

A pair of distal air slots 98 are formed through a side of the conductive pin 90 generally distal of the pin flange 92 and generally aligned with the intake air holes 68 through the base housing 66. The conductive pin 90 preferably is hollow, defining a distal air space 100 between the distal air slot 98 and a medial air slot 102 also formed through a wall of the conductive pin 90 and spaced proximally from the distal air slot 98. A pin divider all 104 is disposed proximal of the medial air slot 102, separating the distal air space 100 from a proximal air space 106 of the pin 90. A proximal air slot 108 is formed through the wall of the conductive pin 90 proximal of the pin divider 104 and communicating with the proximal air space 106 defined within the conductive pin 90 proximal of the pin divider 104. In the illustrated embodiment, the proximal end of the pin 90 is open.

With particular reference to FIGS. 2 and 3, a proximal portion of the base insulator 86 is configured so that its inner surface engages the outer surface of the conductive pin 90 proximal of the proximal air slot 108, and a distal portion of the base insulator 86 is configured so that its inner surface engages the outer surface of the conductive pin 90 adjacent the pin flange 92. An inner diameter of the base insulator 86 is increased between the proximal and distal portions, defining a collector space 110 between the conductive pin 90 and the base insulator 86. The collector space 110 is closed at its distal end by a distal wall 112. Preferably, the collector space 110 defines a leakage trap or catch basin, as will be discussed in more detail below.

Continuing with particular reference to FIGS. 2 and 3, an elongated hollow tube 120 extends from a proximal end to a distal end. In the illustrated embodiment, the hollow tube is configured as a center post 120 having a diameter that increases moving distally through a transition zone 122 so that a larger-diameter portion distal of the transition zone 122 defines an element receiver 124 configured to receive a heating element 126 therewithin. In the illustrated embodiment, the heating element 126 comprises a tubular ceramic wick 132 into which a heating coil 134 is embedded. The illustrated heating element 126 defines a tubular vaporization chamber 136 aligned with a vapor tube 140 of the center post 120 and communicating with the proximal air space 104 of the conductive pin 90. The heating element 126 and vaporization chamber 136 can collectively be referred to as an atomizer 142.

Opposing ends of the heating coil 134 can be arranged in contact with the conductive pin 90 and base housing 66, respectively, so that an electric circuit can be established from the first battery pole through the conductive pin 90 to the heating coil 134, and from the heating coil 134 to the base housing 66 and further to the second battery pole in a manner similar to as discussed in the '596 publication. A cotton gasket 144 can be provided between the ceramic wick 132 and the center post 120, which preferably is formed of a durable metal material. Of course, other embodiments and types of heating elements, such as a coil is embedded into a cotton wick or the like, can be employed.

In the illustrated embodiment, a distal portion of the center post 120 extends into the base housing lumen 82. A center post distal flange 146 engages a base housing proximal stop surface 147, preventing the distal flange 146—and center post 120—from moving further distally relative to the base housing 66. A distal end of the center post 120 preferably engages a proximal offset surface 148 of the base insulator 86 so that the base insulator 86 is sandwiched between the distal end of the center post 120 and the base housing distal flange 94.

Continuing with reference to FIGS. 2 and 3, the tank space 80 is defined between the tubular tank wall 74 and the center post 120. The tank space 80 is configured to hold a vaporizing media M, most preferably a liquid or solid vaporizing media M such as an oil, e-liquid, or wax. A plurality of feeder holes 149 are formed through the center post 120 at the distal end of the tank space 80 and aligned with the heating element 126 so that liquid vaporizing media M can be drawn across the ceramic heating element 126 and atomized by the heating coil 134 in the vaporization chamber 136. An elongated vapor tube 140 is defined by the center post 120 proximal of the vaporization chamber 136 of the heating element 126 and extends proximally to a center post divider wall 150. A vapor opening, or a second side opening 152, is formed through a side wall of the center post 120 distal of the divider wall 150. In the illustrated embodiment, the divider wall 150 is inclined across the interior of the center post 120, and the vapor opening 152 is disposed at the proximal-most side of the divider wall 150.

The center post 120 defines a proximal opening 154 at its proximal end, which opens to a filling path 160 extending distally from the proximal opening to the divider wall 150. A fill opening, or first side opening 162, is formed through the side wall of the center post 120 at the distal end of the filling path 160. In the illustrated embodiment, the fill opening 162 opens to the side of the center post 120 opposite the vapor opening 162 and at the distal-most side of the divider wall 150.

With continued specific reference to FIGS. 2 and 3, the mouthpiece 56 fits onto and over the center post 120 and can be slid distally over the center post 120 so as to sealingly engage the proximal end of the tank wall 74. In the illustrated embodiment, the mouthpiece 56 comprises multiple pieces, including an insert 170, a seal 172, and a cap or top 174. The insert 170 comprises a center aperture 175 configured to fit complementarily over the center post 120 so that an engagement surface 176 of the center aperture 175 sealingly engages the center post 120.

A distal portion of the insert 170 is configured to fit into the tank space 80. The seal 172 extends over the insert 170 so that a distal end of the seal 172 engages a proximal side of an insert flange 178 that extends radially outwardly from the insert 170. The seal 172 is configured to sealingly engage the proximal end of the tank wall 74, as well as the insert 170. The mouthpiece top 174 comprises a distal lumen 179 configured to fit complementarily over the proximal portion of the insert 170 and a proximal outlet lumen 180 extending to the mouthpiece opening 58 at the proximal end of the mouthpiece top 174. A blocking structure 182 divides the proximal lumen 180 from the distal lumen 179, and includes a center aperture 184 sized complementarily to the center post 120 and having a sealing surface 186 configured to sealingly engage the center post 120. In the illustrated embodiment, a proximal surface 188 of the blocking structure 182 is inclined toward the center aperture 184.

Figure 4:
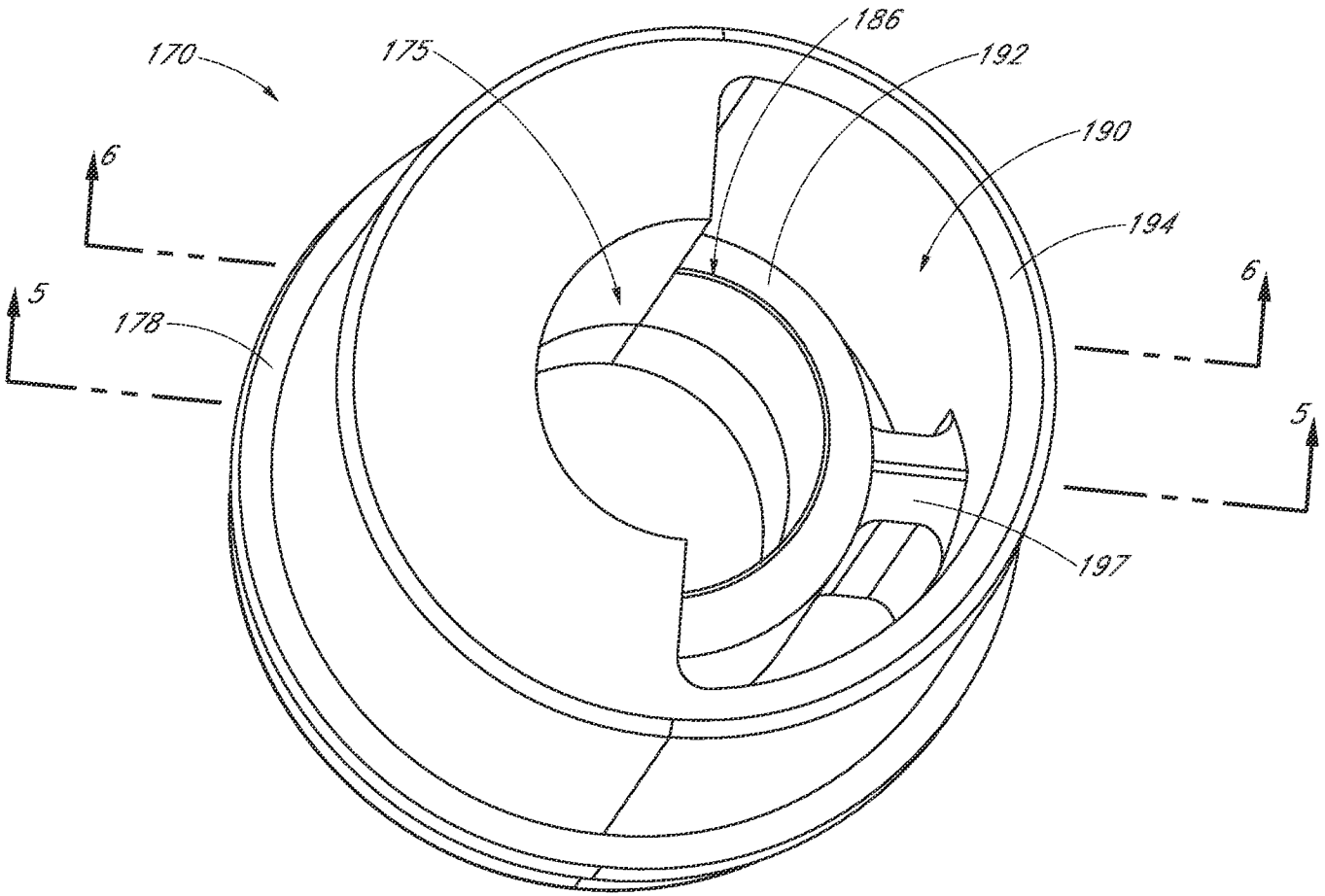
FIG. 4 is a perspective view of an embodiment of an insert for use in a personal vaporizer.
Figure 5:
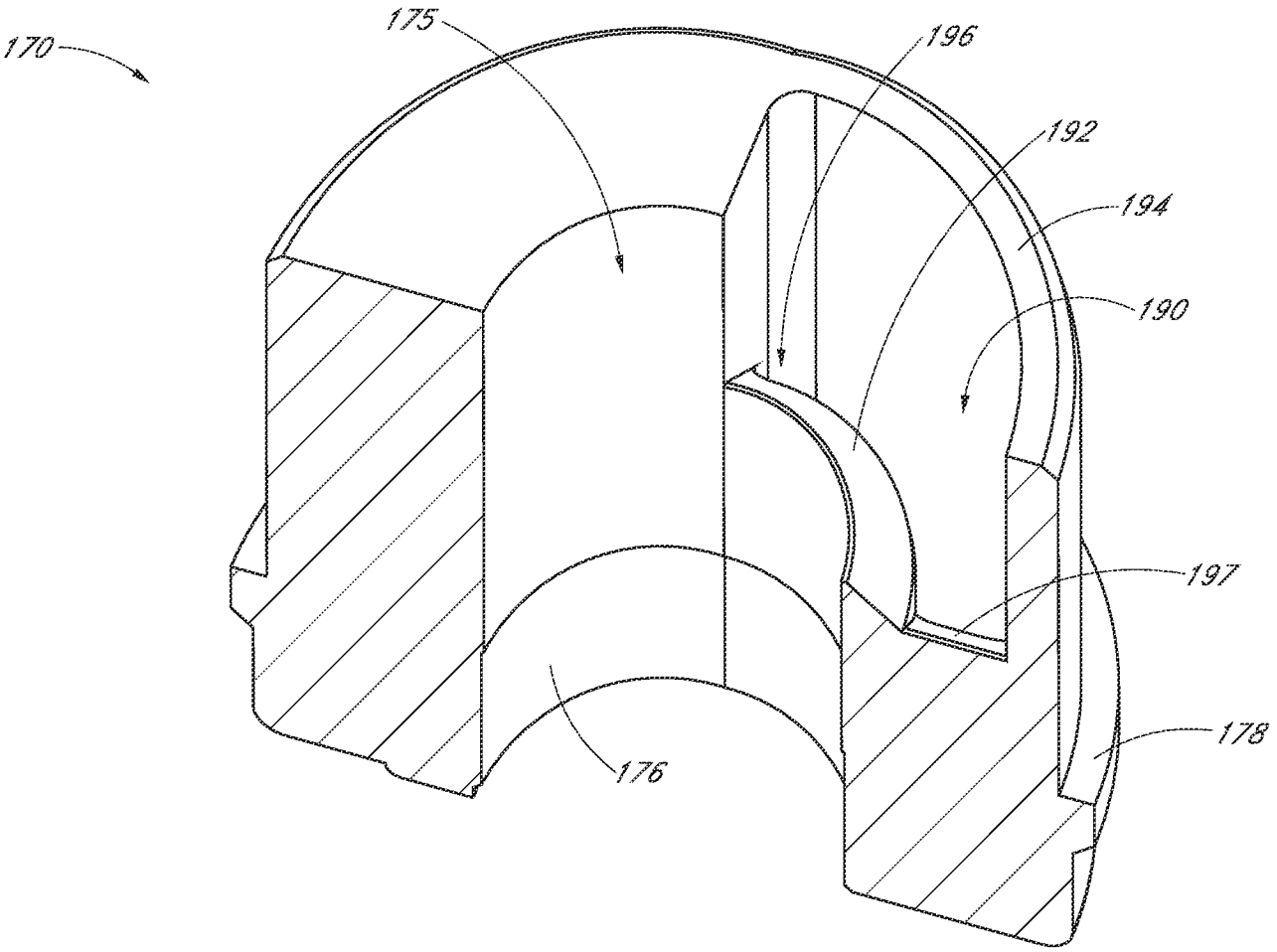
FIG. 5 is a cross-sectional view taken along line 5-5 of FIG. 4.
Figure 6:
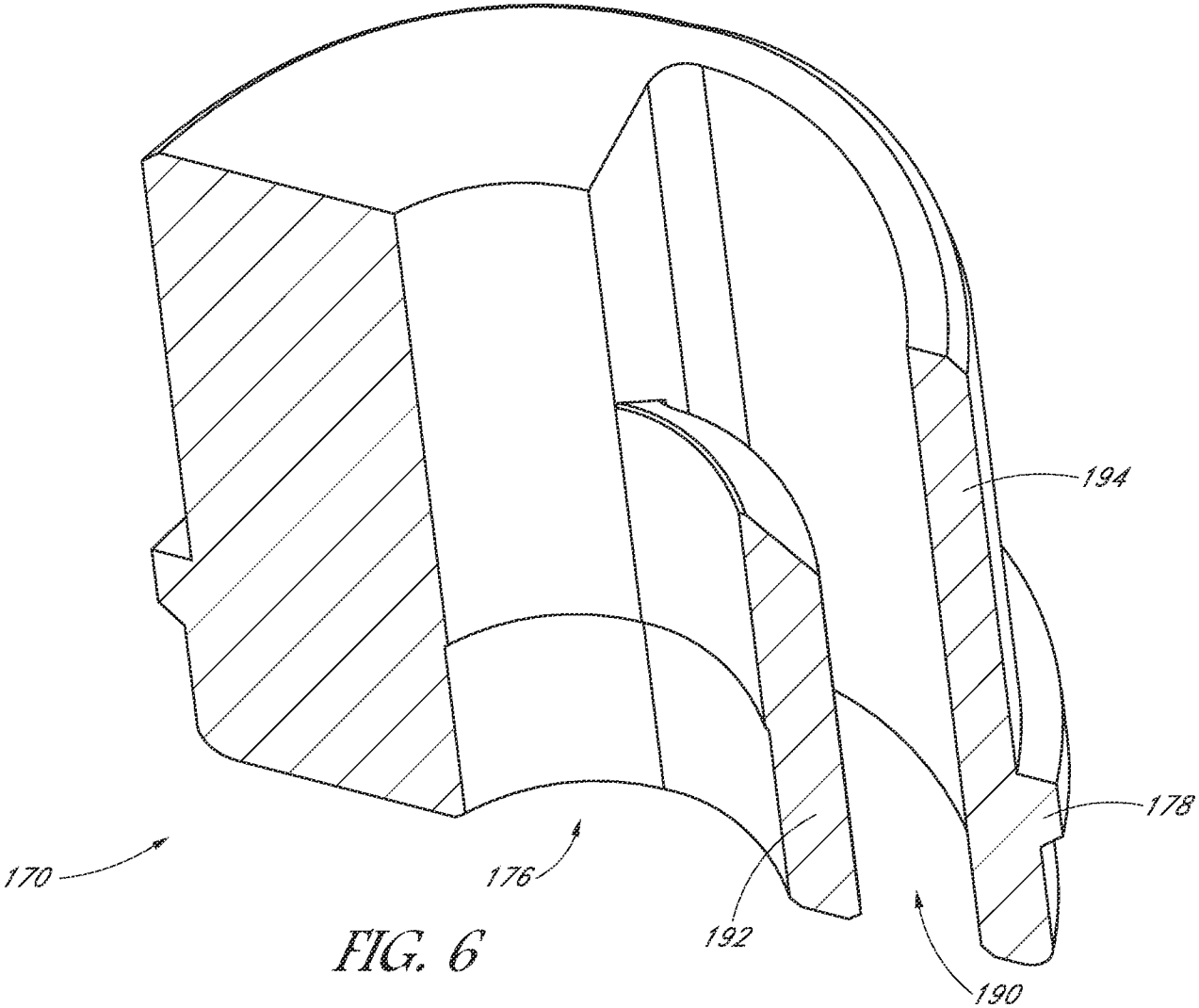
FIG. 6 is a cross-sectional view taken along line 6-6 of FIG. 4.

With additional reference to FIGS. 4-6, a filling space 190, or filling path, defines a pathway longitudinally through the insert 170 but spaced radially from the center aperture 175. In the illustrated embodiment, the filling space 190 is defined between an inner wall 192 and an outer wall 194 of the insert 170. A cutout 196 through the inner wall 192 communicates the center aperture 175 with the filling space 190. In the illustrated embodiment, a strut 197 extends between the outer wall 194 and inner wall 192, providing structural support to prevent the filling space 190 from collapsing under a load.

Figure 7:
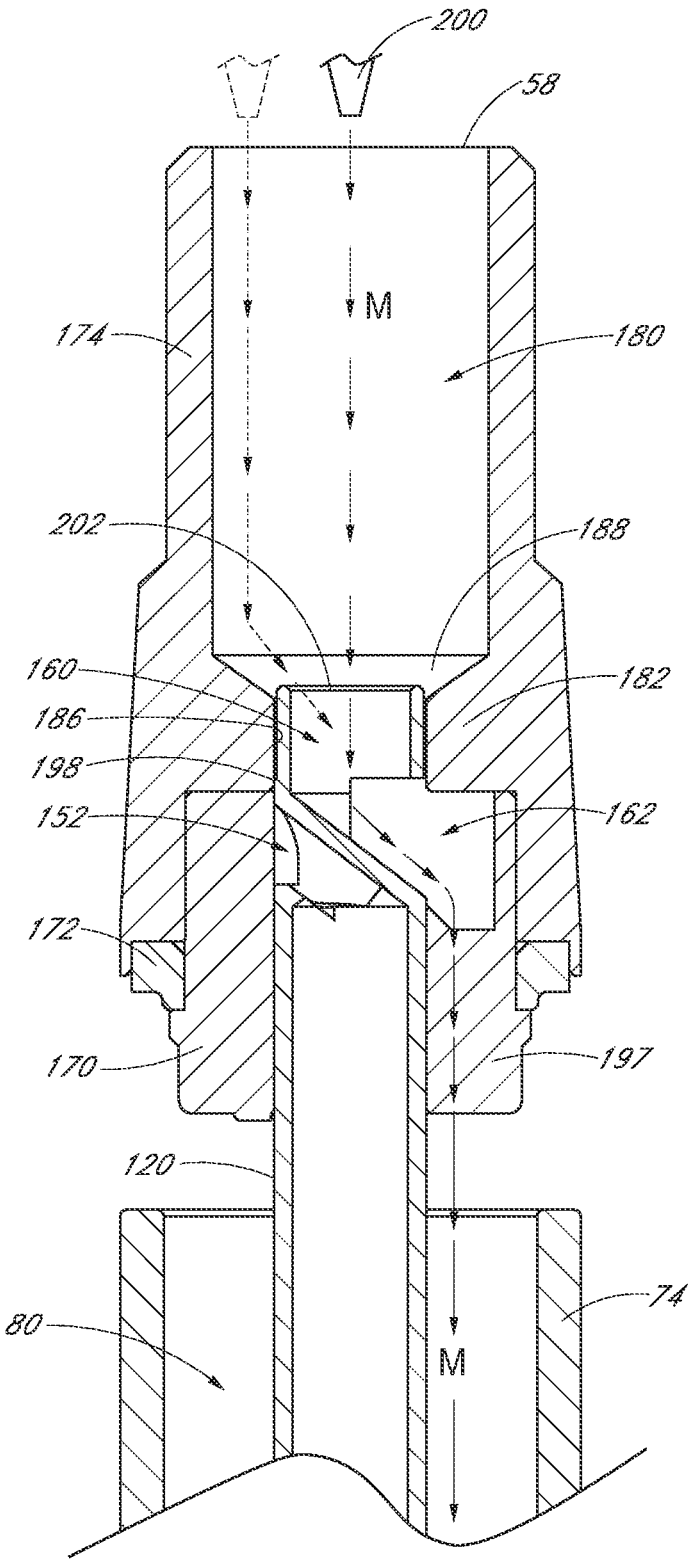
FIG. 7 is a partial close-up view of the arrangement of FIG. 2, depicted in a filling configuration and during filling.
Figure 8:
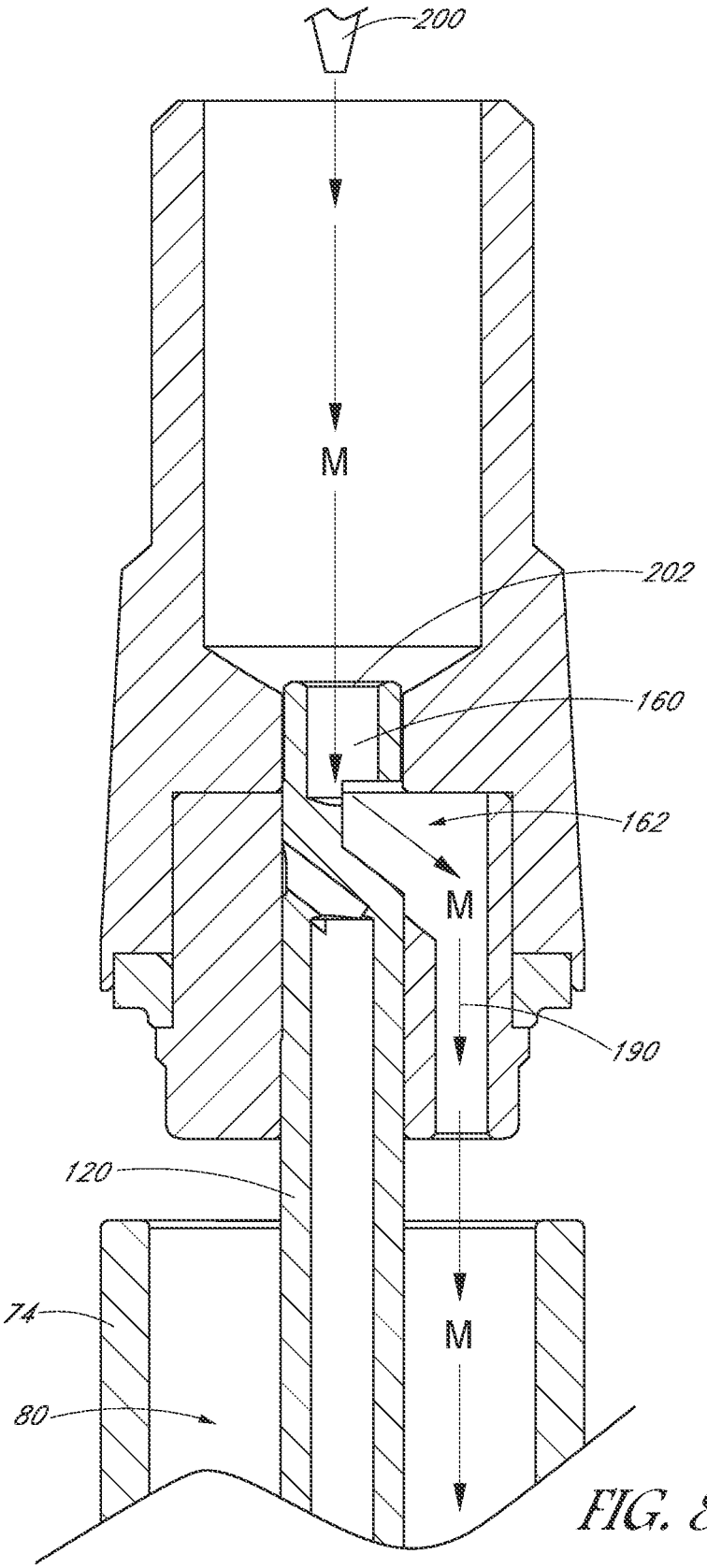
FIG. 8 is a cross-sectional view of the arrangement of FIG. 7, but with the cross-section taken at line 8-8 as depicted in FIG. 2.

With additional reference to FIGS. 7 and 8, the personal vaporizer 50 is shown with the mouthpiece 56 in a first position, or filling position. In some embodiments, during manufacture of the vaporizer 50, the vaporizer 50 is put in this first position prior to the tank 60 being filled with vaporizing media M. In the first position, the engagement surface 186 of the mouthpiece blocking structure 182 is engaged with a proximal end of the center post 120, supporting the mouthpiece 56 spaced proximally from the tank 60. Further, in this first position, the cutout 196 of the insert 170 is aligned with the first side opening 162 so that the filling path 160 of the center post 120 opens into the filling space 190 of the mouthpiece insert 170 via the first side opening 162.

In the illustrated embodiment, a small rib 198 or flange is formed on the center post 120 at about the level of the top of the first side opening 162. As such, when the mouthpiece 56 is initially advanced over the center post 120, the distal surface of the blocking structure 182 contacts the rib 198 when the mouthpiece 56 reaches the first position. When the distal surface of the blocking structure 182 contacts the rib 198 there will be an increase in resistance to further distal movement of the mouthpiece 56 over the center post 120, giving an indication that the first position has been reached. In the illustrated embodiment the center post 120 is milled or otherwise formed to have a smaller outer diameter proximal of the rib 98 so that the rib 98 protrudes radially. In other embodiments, such a rib can be formed by attaching a protuberance, flange or other structure onto the center post 120. Still further, embodiments can provide a visual cue to indicate when the mouthpiece 56 reaches the first position. For example, in the illustrated embodiment the proximal end of the center post 120 is substantially aligned with the inclined bottom surface of the mouthpiece proximal lumen 180 when the mouthpiece 56 reaches the first position.

A vaporizer 50 configured in the first position can be placed in a filling apparatus, such as an automatic filling apparatus, that will position a filling needle 200 so as to be aligned with the mouthpiece opening 58. Liquid vaporizing media M will then be injected by the filling needle 200 through the mouthpiece opening 58. Such media M injected by a filling needle 200 will be directed to the proximal opening 202 of the center post 120, through the center post filling path 160 and out of the first side opening 162 into the insert filling space 190, through which it will flow distally and then into the tank space 80 to fill the tank 60.

In some embodiments, the filling needle 200 will inject media M from a position proximal of the mouthpiece opening 58. In other embodiments, the filling needle 200 will descend distally into the mouthpiece to inject media M. Preferably, the filling needle 200 is aligned with an axis of the vaporizer 50 so that media M is directed directly into and through the proximal opening 202. However, as indicated in ghost lines in FIG. 7, if the filling needle 200 fails to properly align with the center axis of the vaporizer 50, media M will still be injected through the mouthpiece opening 58 and will be directed into and through the proximal opening 202 of the center post 120 and further directed into the tank 60. In the illustrated embodiment, since the blocking surface 188 is inclined toward the center, media flows into and through the proximal opening 202 of the center post 120.

In the illustrated embodiment, the first side opening 162 and second side opening 152 are disposed generally at the same location along the length of the center post 120 but on opposite sides and separated from each other by the divider wall 150. In this embodiment, the divider wall 150 is disposed generally 45° relative to the axis of the center post 120. In other embodiments, the first and second openings can be disposed at different locations, and the divider wall 150 may have a different shape or angle. In the illustrated embodiment, when the mouthpiece 56 is in the filling position, the first opening 162 is aligned with the cutout 196 so as to be in communication with the tank space 80, and the second opening 152 is blocked by the engagement surface 176 of the insert 170 so as to preferably be sealed off from communication with the tank space 80.

Figure 9:
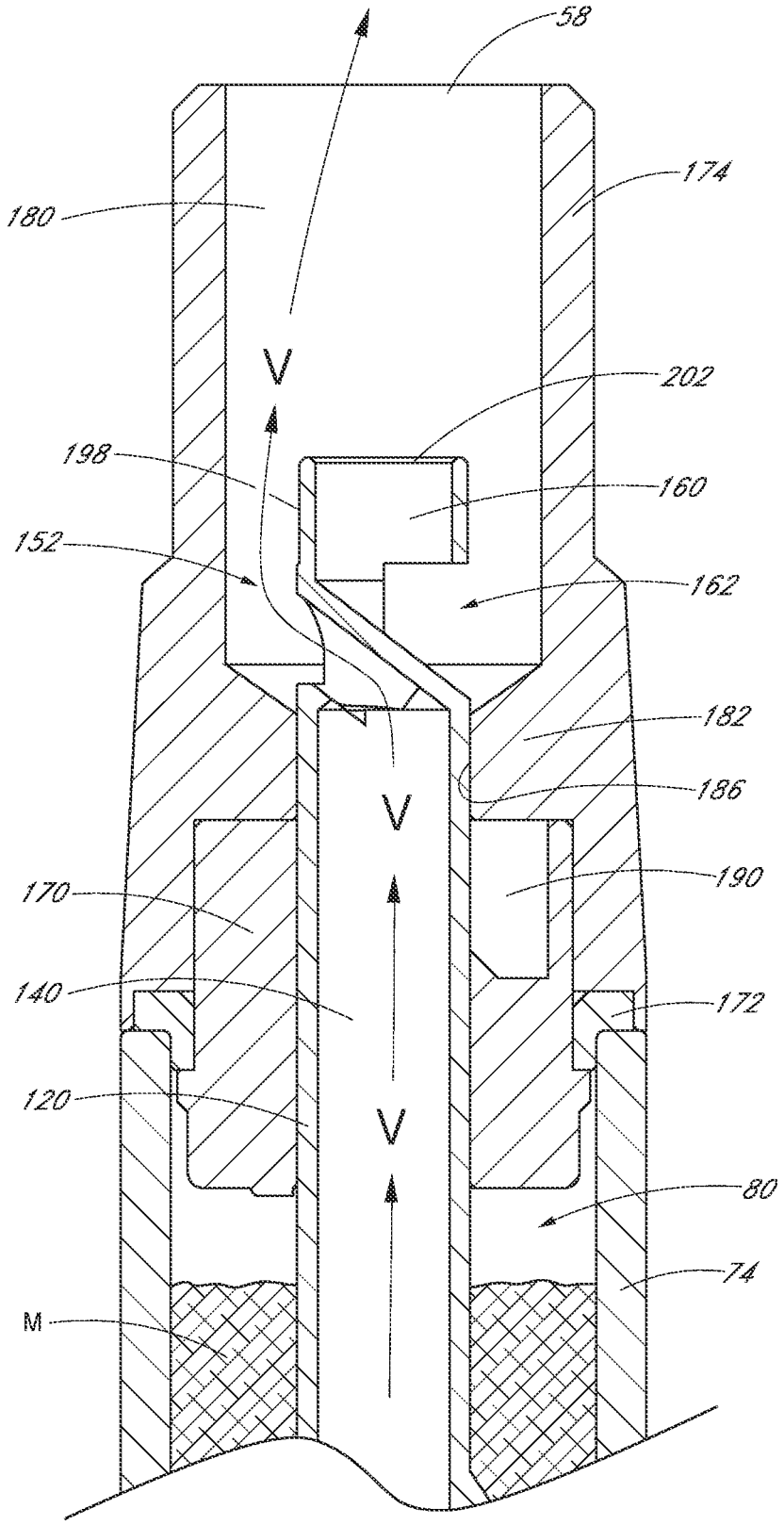
FIG. 9 is a partial close-up view of the arrangement of FIG. 2, depicted assembled and during use.
Figure 10:
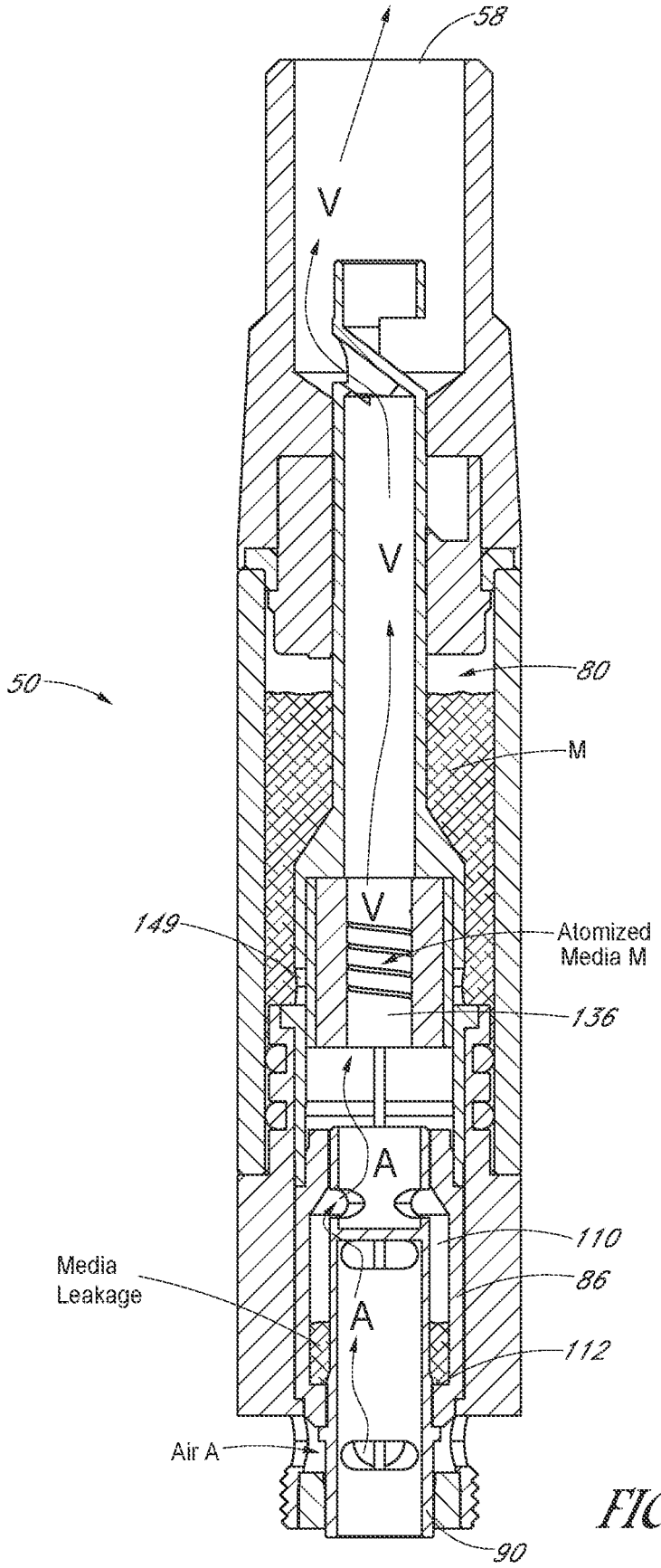
FIG. 10 shows the arrangement of FIG. 2 after filling and during use.
Figure 11:
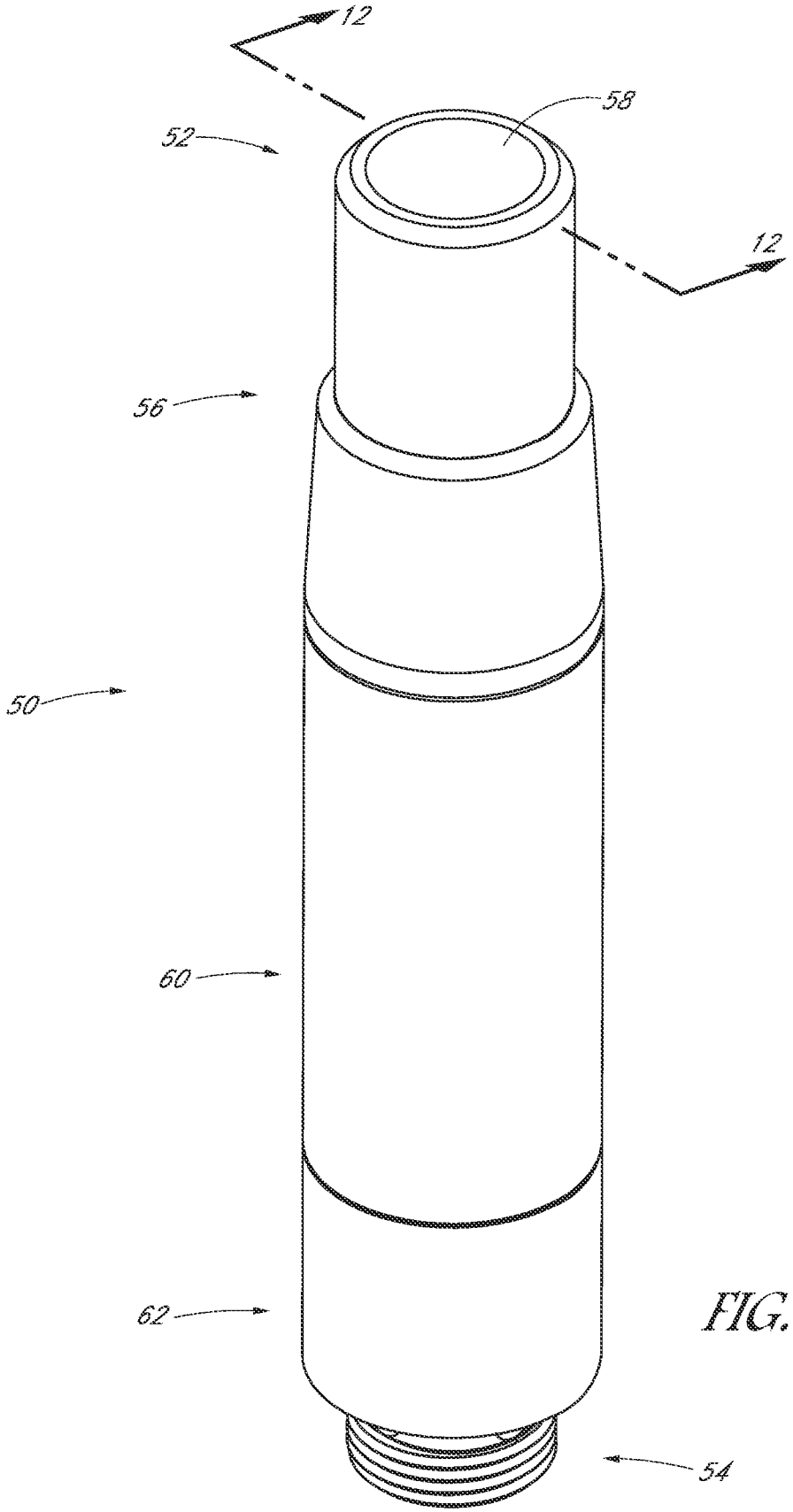
FIG. 11 is a perspective view of another embodiment of a personal vaporizer.

With reference next to FIGS. 9 and 10, after the tank 60 is filled, the mouthpiece 56 can be pushed distally so that it moves distally over the center post 120 so as to push the insert 170 into the proximal portion of the tank space 80 and engage the seal 172 and mouthpiece top 174 with the proximal end of the tank wall 74. As such, the tank space 80 is now sealed off by the seal 172. In this configuration, the vaporizer 50 is ready for use. This configuration can be referred to as an assembled configuration, or the mouthpiece 56 being in a second position or use position.

In the second position, the engagement surface 186 of the mouthpiece blocking structure 182 sealingly engages the center post 120 distally of both the first and second openings 162, 152. As such, the second side opening 152, or vapor opening, opens into the proximal lumen 180 of the mouthpiece top 174. The vapor tube 140 thus communicates with the proximal lumen 180 and thus the mouthpiece opening 58. The proximal opening 202 and first side opening 162 of the center post 120 are also disposed within the proximal lumen 180, and in fact the filling path 160 is disposed within the proximal lumen 180 as well. However, such structure has become superfluous, as the tank space 80 is now sealed off from any communication with the center post filling path 160 or mouthpiece opening 58.

With continued reference to FIGS. 9 and 10, with the mouthpiece 56 in the second position, the vaporizer 50 is fully assembled and ready for use. The vaporizer 50 can be connected to a battery in a known manner. The user actuates the heating coil 134 and draws a breath through the mouthpiece 56. The heating element 126 draws vaporizing media M from the tank space 80 through the feed holes 149 and atomizes such media M in the vaporization chamber 136. Intake air is drawn through the intake air holes 68 in the base housing 66, into the distal air slots 98 and through the distal air space 100 of the conductive pin 90, out the medial air slots 102 through the collector space 110 and through the proximal air slots 108 into the proximal air space 104 of the conductive pin 90 and further proximally to the vaporization chamber 136, where the air A is mixed with atomized media M to form a high-quality vapor V. The vapor V is drawn proximally into and through the vapor tube 140, through the second side opening 152 and into the proximal lumen 180 of the mouthpiece 56, and further out the mouthpiece opening 58.

As shown, in the illustrated embodiment, when the mouthpiece 56 is in the first position the mouthpiece opening 58 communicates with the tank space 80 but is blocked from communication with the vaporization chamber 136 and vapor tube 150. However, in the second position, the mouthpiece opening 58 is in communication with the vaporization chamber 136 but is blocked from communication with the tank space 80. Thus, having the mouthpiece 56 in the first position accommodates easy filling through the mouthpiece opening 58, and moving the mouthpiece 56 to the second position seals the tank 60 while facilitating typical use of the vaporizer 50 to generate a vapor that is drawn through the mouthpiece opening 58. It is to be understood that this principle can be applied with several different specific structural configurations other than that described herein in connection with FIGS. 1-10. Some other embodiments will be discussed below, but it is to be understood that still further structures employing these principles are contemplated.

With specific reference to FIG. 10, the illustrated embodiments also address another situation that can arise with personal vaporizers. For example, as discussed in the '596 publication, during periods of nonuse, sometimes a portion of the liquid media M can leak through the wicking heat element and drip distally. In some embodiments, such as in the '596 publication, a check valve stems such leakage. In the illustrated embodiment, such leakage is allowed to drip distally into and through the proximal air space 104 of the conductive pin 90, through the proximal air slots 108 and into the collector space 110 defined between the conductive pin 90 and base insulator 86. This collector space 110 can function as a trap or basin for containing such media M so that it neither leaks out of the device nor interferes with air flow. As shown, the medial air slots 102 are spaced proximally from the bottom or distal end of the collector space 110. Thus, media M is unlikely to flow through the medial air slots 102 and on to the intake openings 68. Media M that accumulates in the collector space 110 will not interfere with intake air flow through the conductive pin 90 as the medial and proximal air slots 102, 108 will be proximal of the collected media M. This arrangement is especially helpful when the vaporizer 50 is used with media that is solid at room temperature, such as waxes or crystalline media. It is also to be understood that additional embodiments can employ structure in which a portion of heat from the atomizer 142 is communicated to the tank 60 in order to warm, and decrease the viscosity of, media in the tank 60. Applicant's copending application Ser. No. 16/513,701 (the '701 application), filed Jul. 16, 2019, discusses embodiments of passive and active structures for heating media. The entirety of the '701 application is hereby incorporated by reference. Heat can also be communicated along the conductive pin 90 to media that may be within the collector space 110 so that, during use, at least a portion of such media may be drawn with the intake air into the atomizer 142 and atomized.

FIGS. 11-20 illustrate another embodiment of a personal vaporizer 50. In this embodiment, structure of the base housing 66, tank 60 and heating element 126 can be substantially the same as in embodiments discussed above. Also, the hollow tube 120, or center post 120, can be much the same as described above, but with a few differences that will be discussed herein. For example, a center post medial flange 206 extends outwardly from a portion of the center post 120 disposed within the tank space 80. Also, an elongated key slot 208 extends longitudinally from the proximal end to the first side opening 162.

In the illustrated embodiment, the mouthpiece 56 comprises an insert 170, a circular seal 172 and a mouthpiece top 174. The insert 170 is elongated and configured to fit through a proximal end of the tank wall 74 and into the tank space 80. A distal flange 178 extends radially from the outer surface of the insert 170. A center aperture 175 extends longitudinally through the insert 170 and is sized complementarily to the center post 120. An engagement surface 176 of the center aperture 175 is configured to sealingly engage the center post 120. An elongated key ridge 210 extends radially inwardly from the engagement surface 176 of the center aperture 175 and distally from the proximal end thereof. A vapor space 212 extends longitudinally from the proximal end of the insert 170 distally to a distal wall 214. The engagement surface 176 opens to the vapor space 212, which is offset radially from the axis of the insert 170. An elongated filling space 190 is also spaced radially from the center aperture 175 and communicates with the center aperture 175, but preferably on the opposite side of the axis from the vapor space 212. The filling space 190 extends distally from a proximal end wall 222 to the distal end of the insert 170. Preferably, the proximal end wall 222 of the filling space 190 is distal of the distal end wall 214 of the vapor space 212. In the illustrated embodiment, a strut 224 extends radially inwardly within the filling space 190, and is configured to engage the center post 120 so as to support the insert 170 and prevent the filling space 190 from collapsing if the insert 170 is subjected to a load.

The illustrated mouthpiece top 174 has a seal seat 226 at its distal end that is configured to receive the circular seal 172 therein. To assemble the mouthpiece 56, the seal 172 and top 174 can be advanced over the insert 170 until an offset surface 228 within the mouthpiece top 174 engages the proximal end of the insert 170.

Figure 18:
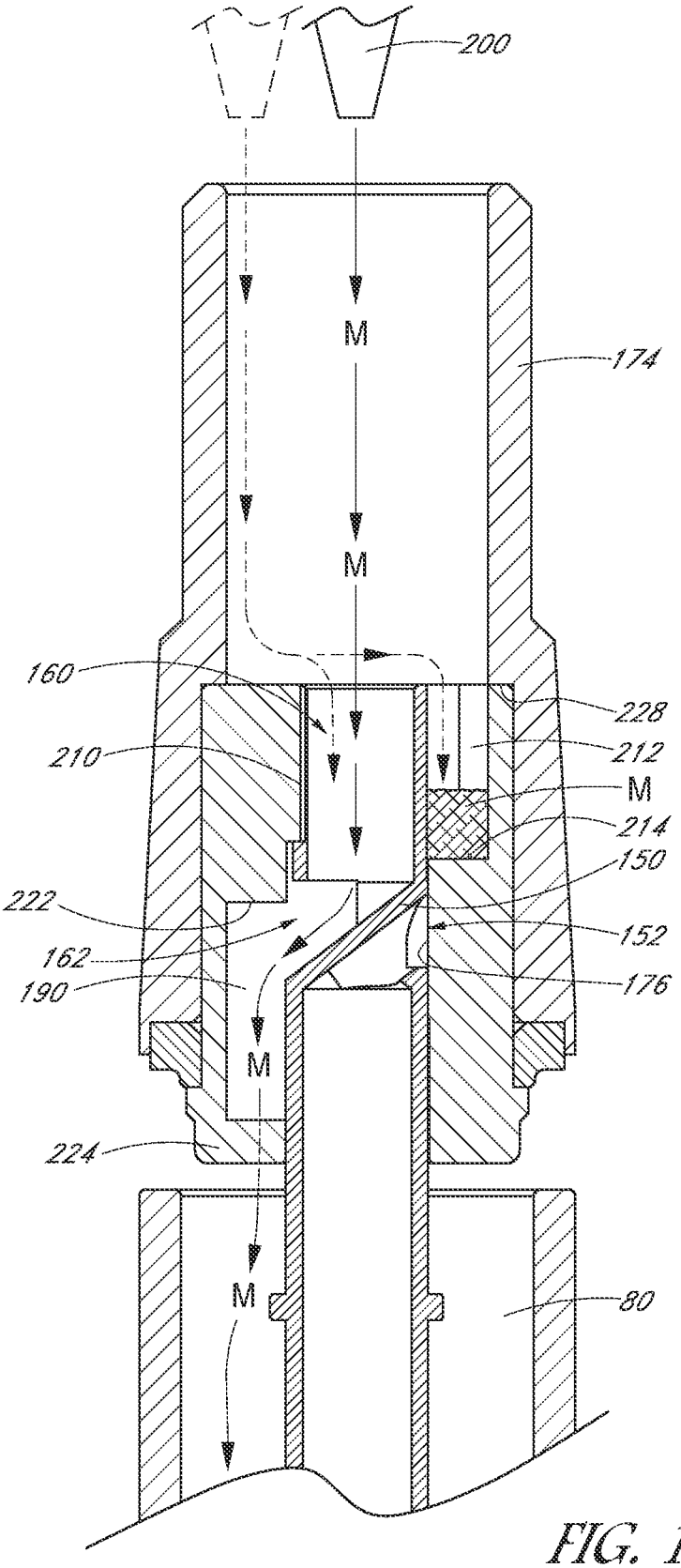
FIG. 18 is a partial view of the arrangement of FIG. 12 depicted in a filling configuration and during filling.
Figure 19:
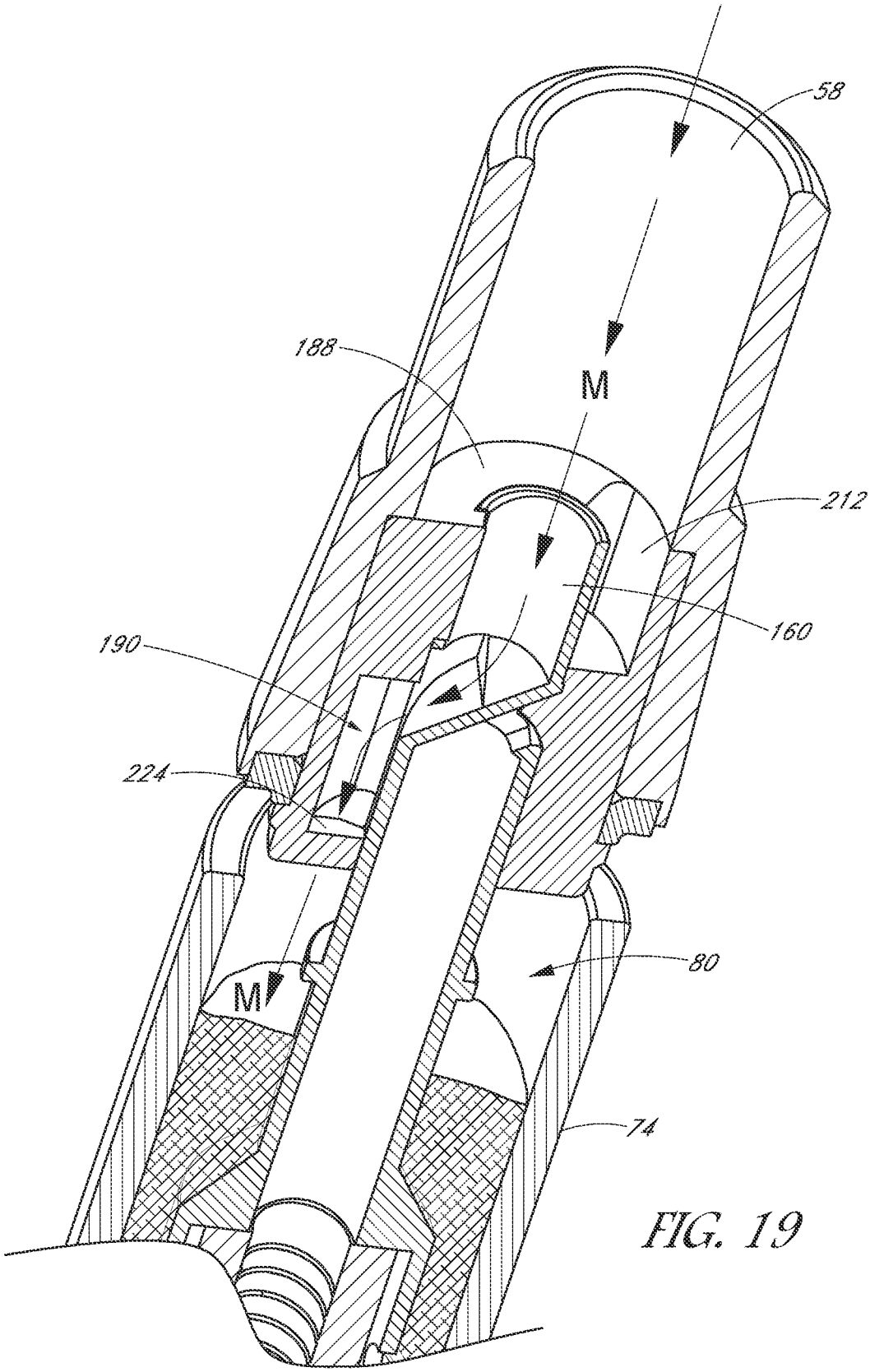
FIG. 19 is a perspective view of the arrangement of FIG. 18.

With specific reference to FIGS. 18 and 19, during manufacturing the vaporizer 50 can be assembled so that the mouthpiece 56 is advanced over the center post 120 to a first position, or fill position, as depicted in these figures. Preferably, in order to advance the mouthpiece 56 over the center post 120, the key ridge 210 of the insert 170 must be aligned with the key slot 208 so that the key ridge 210 slides within the key slot 208. The mouthpiece 56 is then advanced distally so that the proximal end of the insert 170 is generally aligned with the proximal end of the center post 120, putting the mouthpiece 56 into the first position. With the key ridge 210 within the key slot 208, the mouthpiece 56 is positioned at a desired alignment relative to the center post 120 so that the filling space 190 of the insert 170 is aligned with the first side opening 162 and the second side opening 152 is blocked and sealed by the center aperture engagement surface 176. The distal end 214 of the vapor space 212 remains proximal of the second side opening 152.

Continuing with reference to FIGS. 18 and 19, a filling needle 200 can be aligned with the mouthpiece opening 58 and inject liquid media M therethrough, which liquid media will flow through the proximal opening of the center post 120 into and through the filling path 160 and out the first side opening 162 into the filling space 190 of the insert 170, from which it will be directed distally into the tank space 80 in order to fill the tank 60 with liquid media M. As with other embodiments, the filling needle 200 preferably is aligned with the axis of the vaporizer 50 so that media is injected directly into the center post filling path 160. However, in the event the filling needle 200 is somewhat misaligned, the injected media M will still be injected into the proximal lumen 180 of the mouthpiece 56, and thus all or most of the media M will flow through the proximal opening into the filling path 160 and eventually to the tank space 80. Although a small portion of media M conceivably can flow into and be the contained in the vapor space 212, such portion of media is not a substantial volume. In another embodiment, a supplemental opening through the center post 120 can be provided and positioned to align with the distal end 214 of the vapor space 212 when the mouthpiece 56 is in the first position. As such, if media flows into the vapor space 212, it will drain into the post filling path 160.

Figure 12:
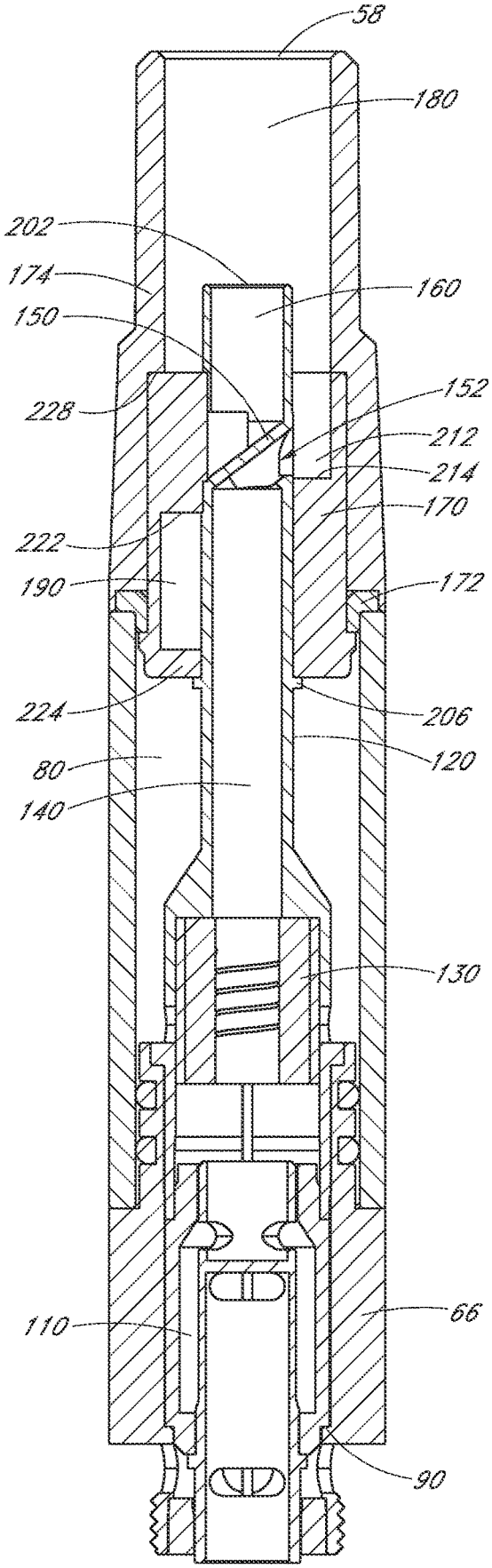
FIG. 12 is a cross-sectional view taken along line 12-12 of FIG. 11.
Figure 13:
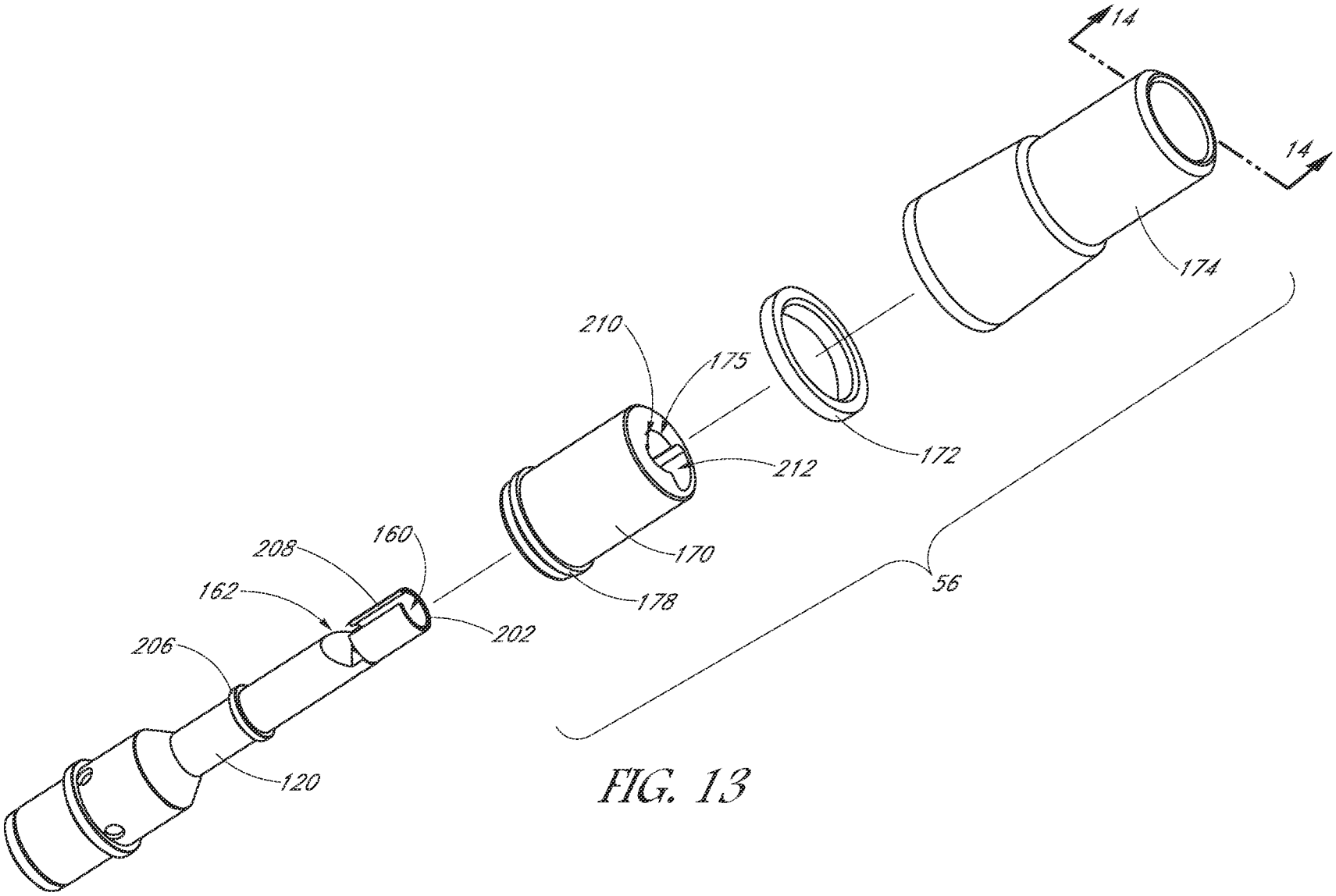
FIG. 13 is an exploded view of the arrangement of FIG. 11.
Figure 14:
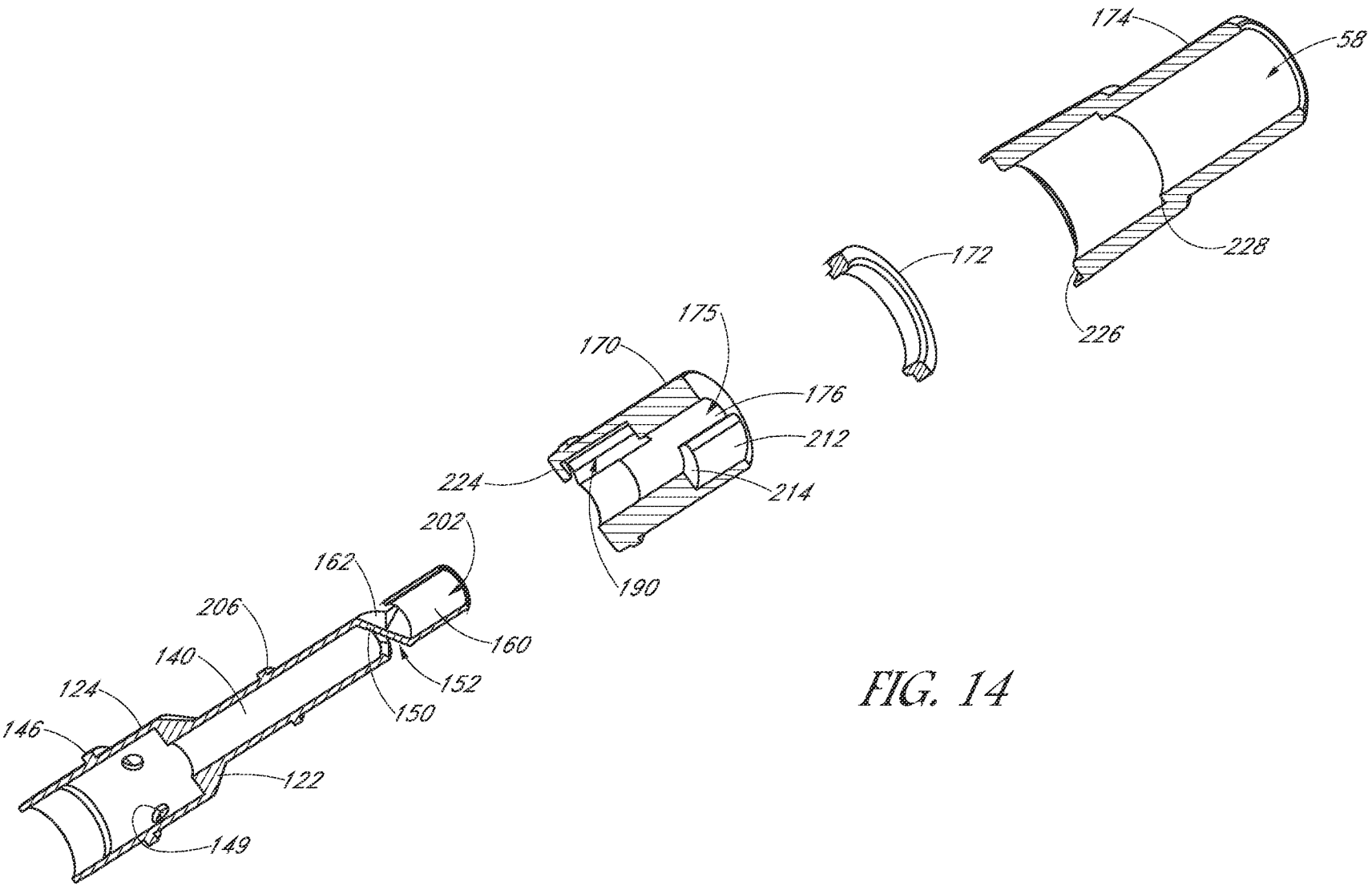
FIG. 14 is a cross-sectional view taken along line 14-14 of FIG. 13.
Figure 15:
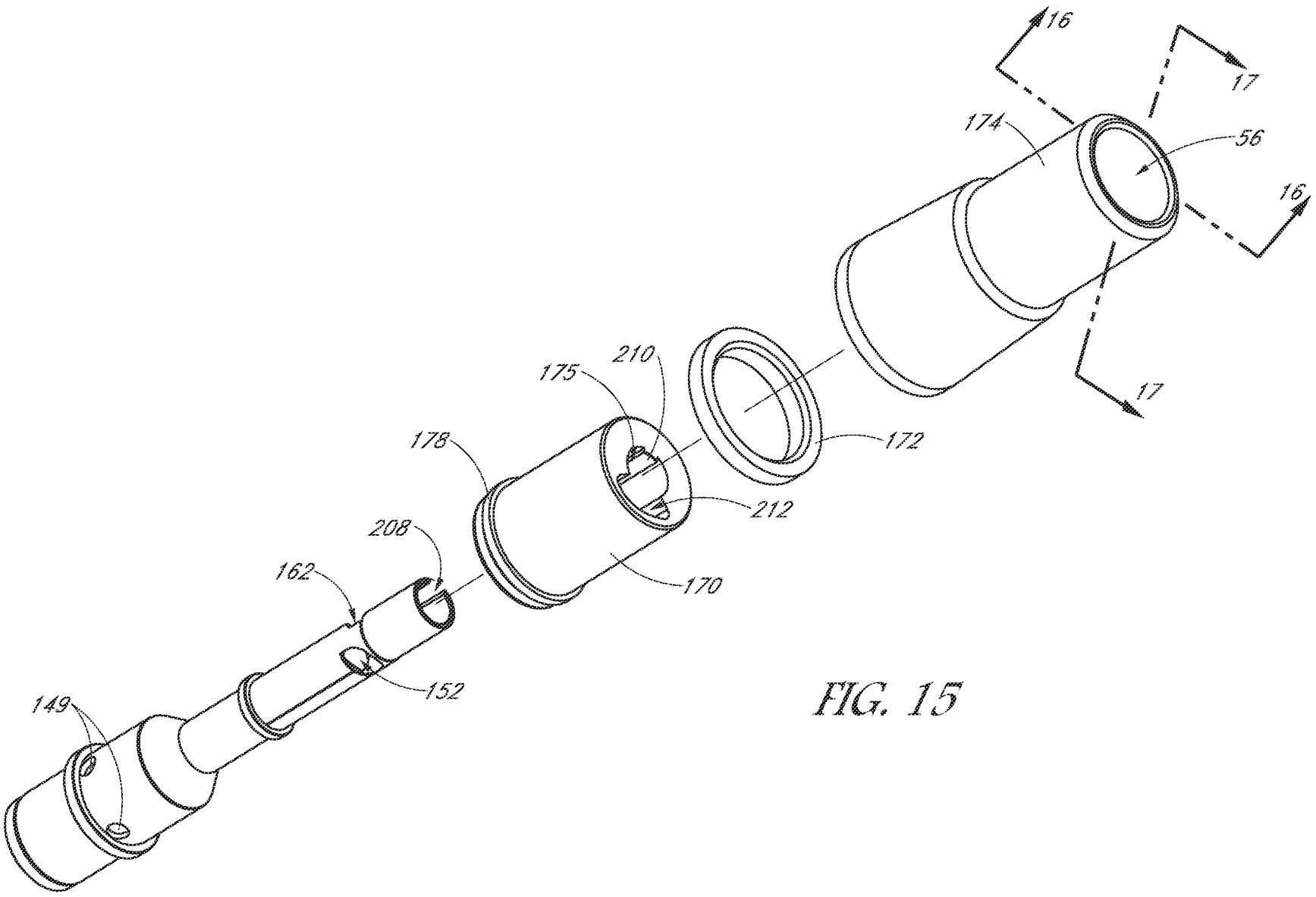
FIG. 15 is another exploded view of the arrangement of FIG. 11.
Figure 16:
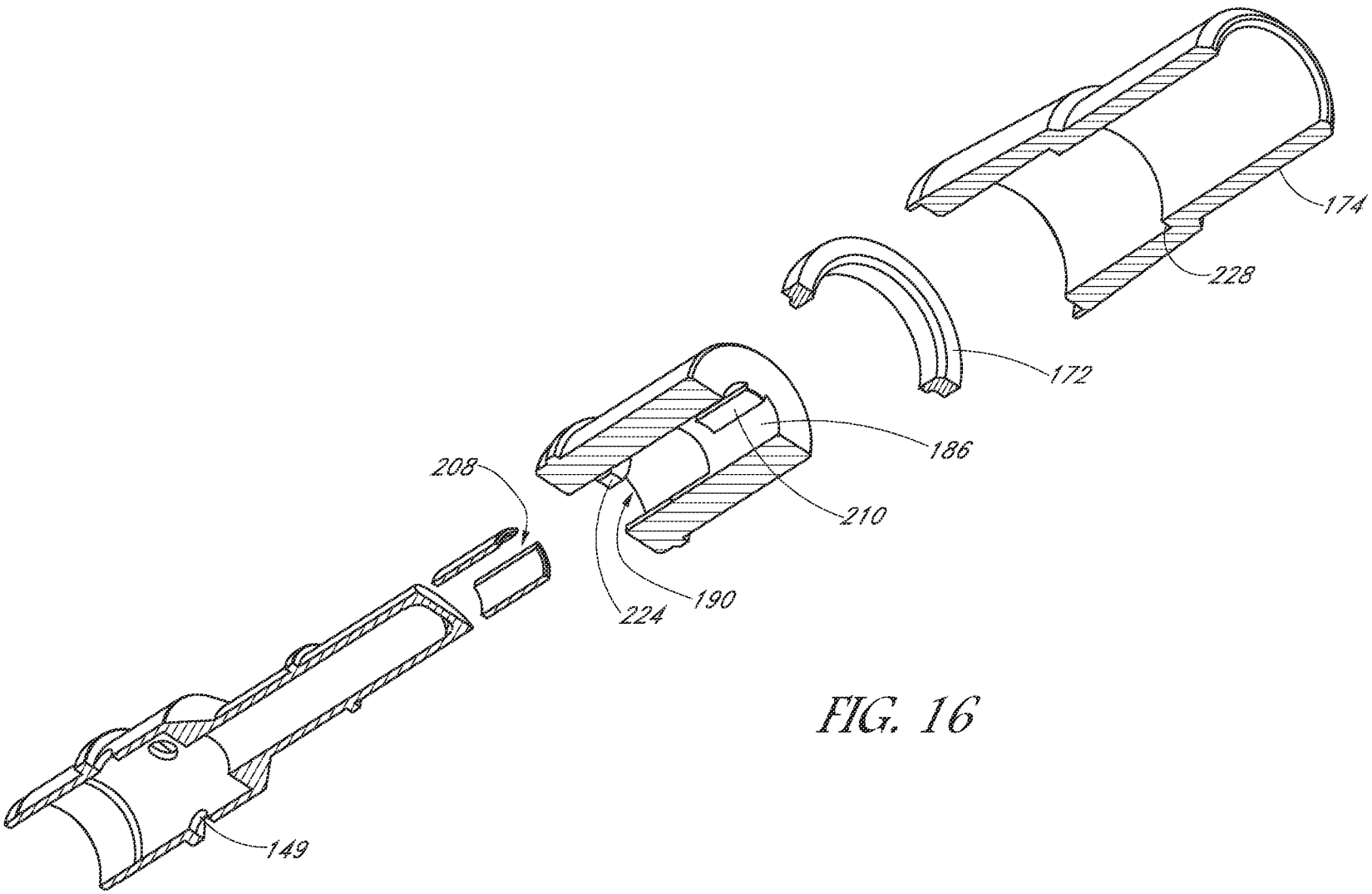
FIG. 16 is a cross-sectional view taken along line 16-16 of FIG. 15.
Figure 17:
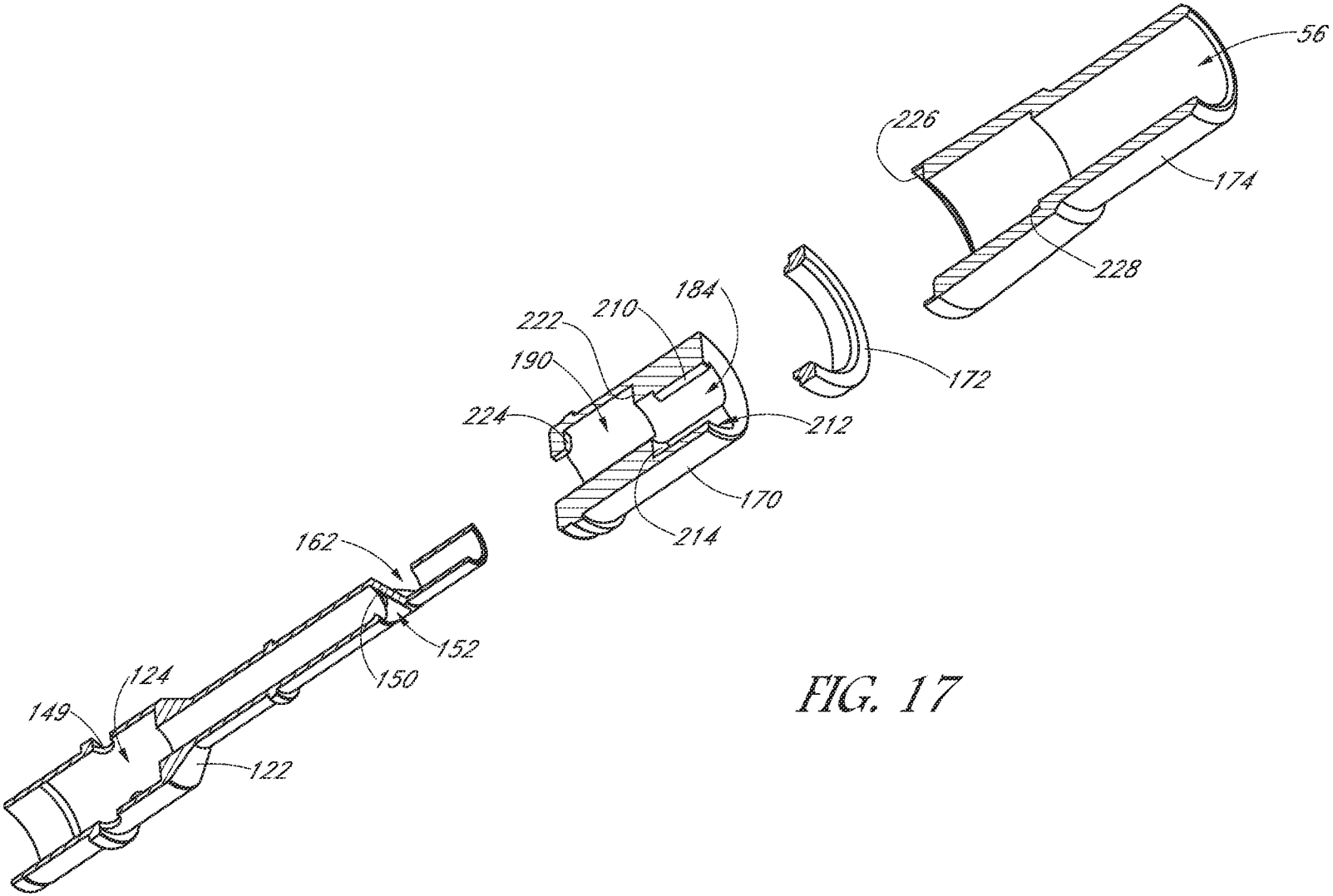
FIG. 17 is a cross-sectional view taken along line 17-17 of FIG. 16.
Figure 20:
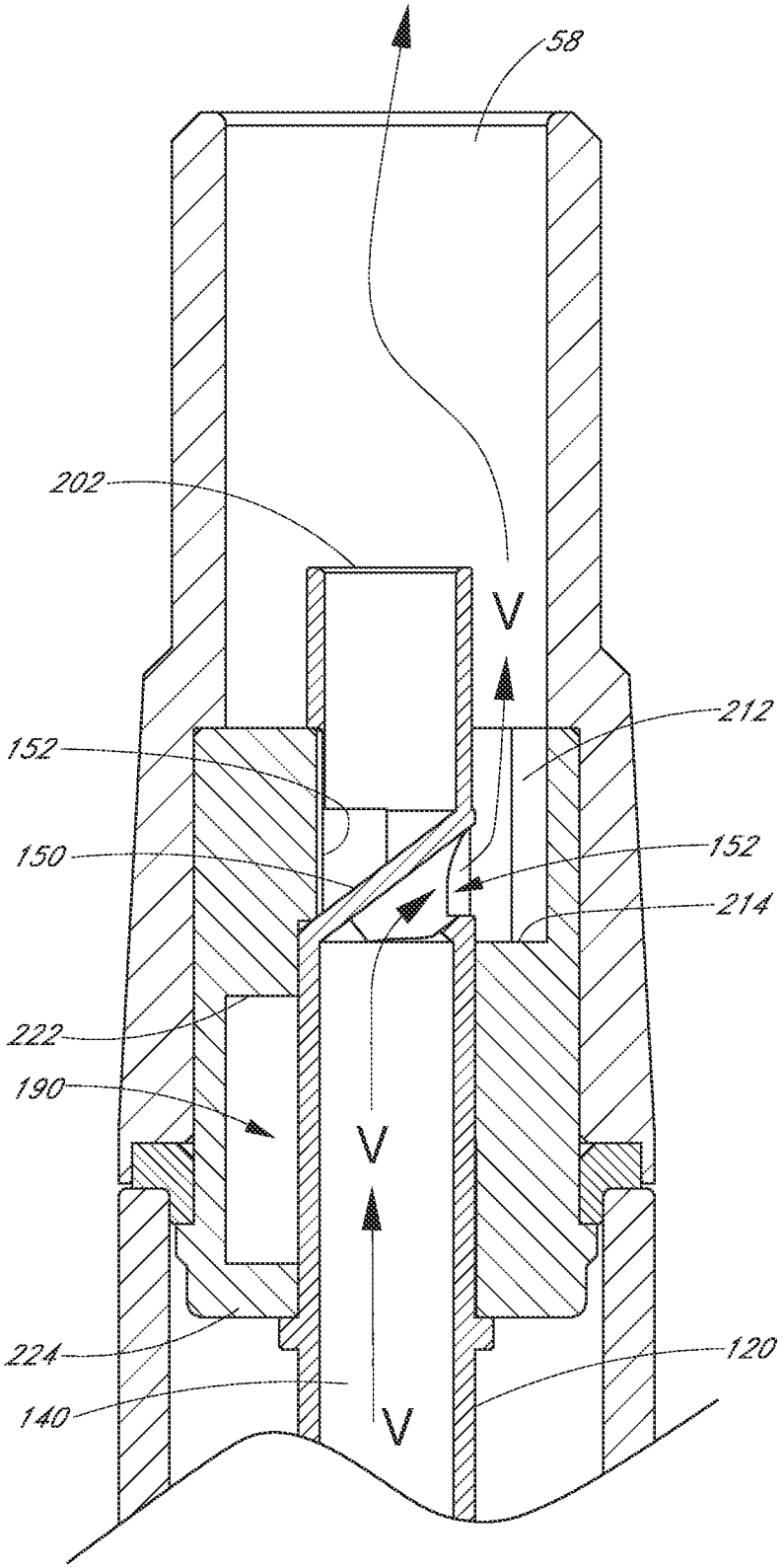
FIG. 20 is a partial view of the arrangement of FIG. 12, depicted during use.
Figure 21:
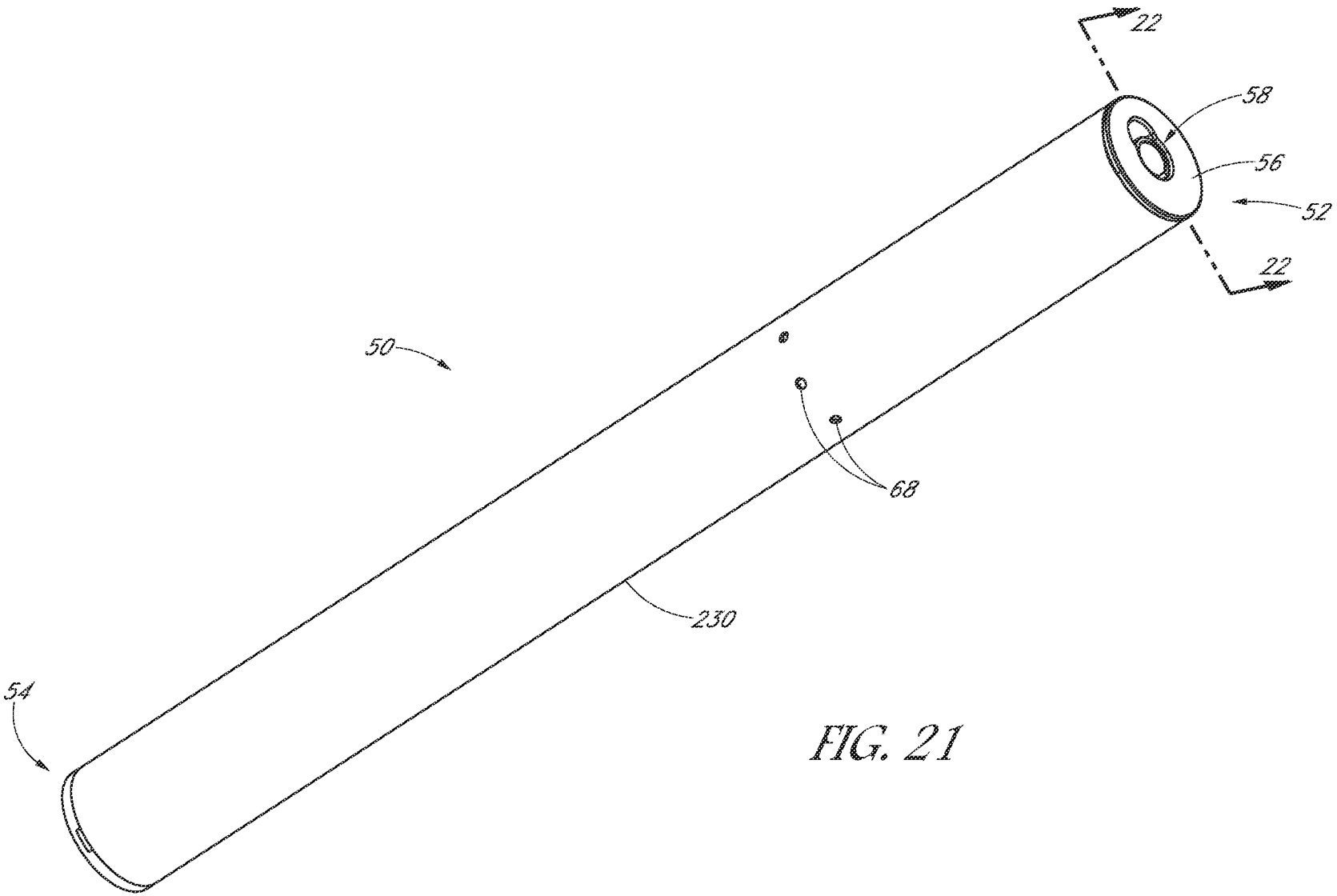
FIG. 21 is a perspective view of another embodiment of a personal vaporizer.

With reference next to FIGS. 20 and 12, once the tank 60 has been filled, the mouthpiece 56 can be pushed distally to a second position, or fully assembled configuration, in which the seal engages the proximal end of the tank wall 74, the insert aperture engagement surface 176 engages the center post 120 so as to block the insert filling space 190 from communicating with the first or second side opening 152 of the center post 120 and to orient the bottom end wall 214 of the vapor space 212 distally of the second side opening 152 so that the second side opening 152, or vapor opening, opens into the vapor space 212. As such, liquid media M in the tank space 80 is blocked from flowing into the mouthpiece lumen 180, but vapor V moving through the vapor tube 140 flows readily through the second side opening 152 into the vapor space 212 of the insert 170 and into the mouthpiece lumen 180, and further to and through the mouthpiece opening 58.

As discussed above, if the filling needle 200 is misaligned, a portion of media may enter the vapor space 212 of the insert 170. Although such media will be trapped in the vapor space 212 during filling, once the mouthpiece 56 is pushed to the second position, the media can flow through the second side opening 152 and distally through the vapor tube 140 to the heating element 126. While much of such media may be absorbed by the heating element wick 132, a portion may flow distally into the collector space 110 or basin. In this manner, such media will not interfere with the air flow or other operation of the vaporizer 50.

With reference next to FIGS. 21-28, another embodiment of a personal vaporizer 50 comprises an elongated outer casing 230 that encloses a battery element 232 and associated power conditioning circuitry therewithin distal of vaporizer 50 structures, which are also enclosed in the outer casing 230. In this embodiment, an elongated base insert 234 fits complementarily within the outer casing 230 and includes an O-ring 72 to create a seal with the inner surface of the casing 230. The illustrated base insert 234 supports structures such as a conductive pin 90, an insulator 86, a heating element 126 and the hollow tube, or center post 120, which can feature structure similar to the embodiments described above. A tank space 80 is defined within the casing 230 proximal of the base insert 234 in between the casing 230 and the center post 120. A plurality of inlet holes 68 preferably are formed through the outer wall of the casing 230 proximal of the battery 232 and leading to an inlet air space 236 which in turn communicates with the proximal air space 104 of the conductive pin 90.

Figure 23:
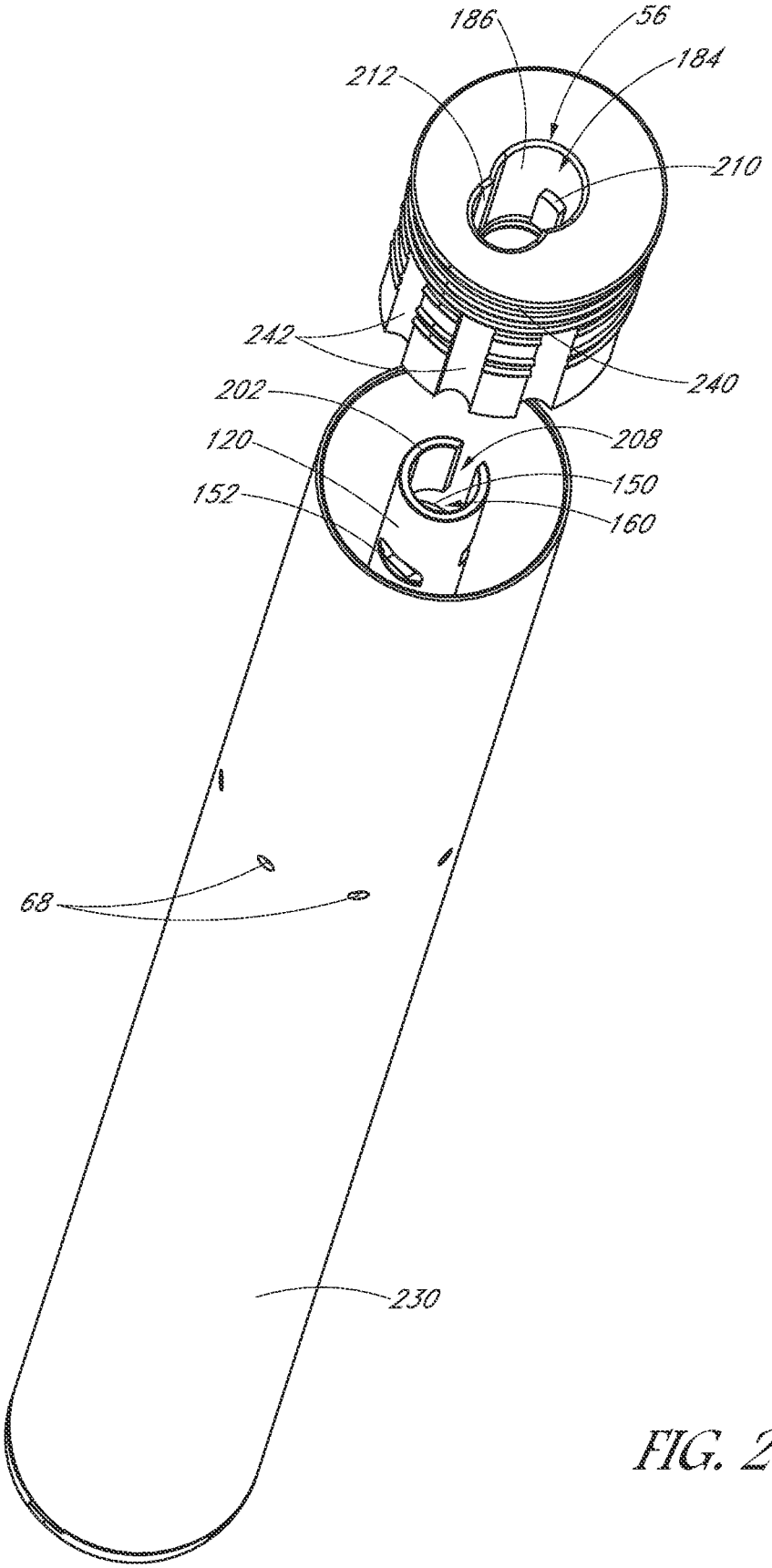
FIG. 23 is a partially-exploded view of the personal vaporizer of FIG. 21.
Figure 24:
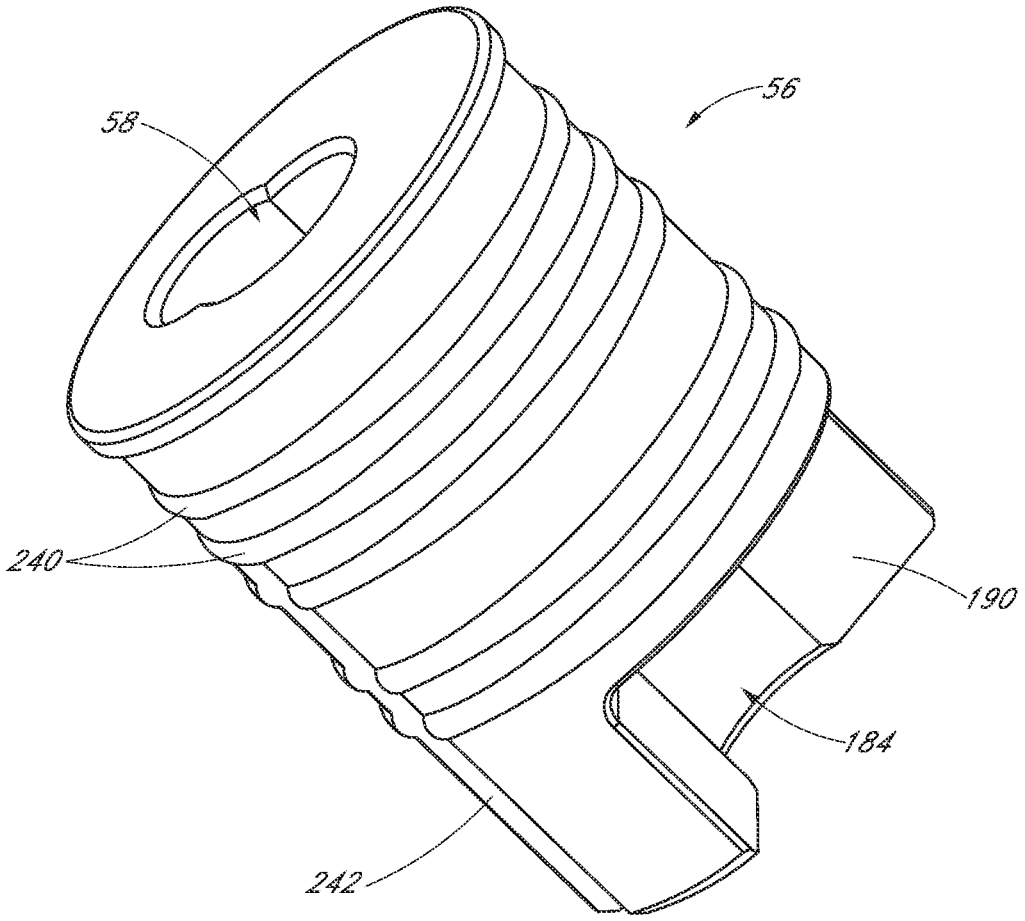
FIG. 24 is a perspective view of an embodiment of a mouthpiece for the personal vaporizer of FIG. 21.

With particular reference to FIGS. 23-24, the mouthpiece 56 preferably is formed of an elastomeric material and comprises a center aperture 175 defining an engagement surface 176 configured to complementarily and sealingly engage the center post surface. A vapor space 212 is defined radially spaced from an axis of the mouthpiece 56 and extends longitudinally to a bottom end wall 214. The center aperture 175 opens into the vapor space 212 along the length of the vapor space 212. A filling space 190 is disposed radially spaced from the axis of the mouthpiece 56 on a side of the axis opposite the vapor space 212 and extends distally from a proximal end wall 222. Preferably the proximal end wall 222 of the filling space 190 is distal of the distal end wall 214 of the vapor space 212. In the illustrated embodiment, the filling space 190 is simply a void cut out of the distal end of the mouthpiece 56 on the side opposite the vapor space 212. Also, in the illustrated embodiment, the mouthpiece opening 58 comprises the proximal end of the center aperture 175 as well as the proximal end of the vapor space 212.

The illustrated mouthpiece 56 is configured to fit into a proximal end of the outer casing 230 and comprises a plurality of sealing structures 240 configured to establish a seal with the inner surface of the outer casing 230. In the illustrated embodiment, a plurality of elongated vent slots 242 extend proximally from a distal end of the mouthpiece 56 and terminate distal of the sealing structures 240. An elongated key ridge 210 extends inwardly from the engagement surface 176 of the center aperture 175 and is configured to complementarily fit slidably within a key slot 208 formed in the center post 120 to properly align the mouthpiece 56.

Figure 25:
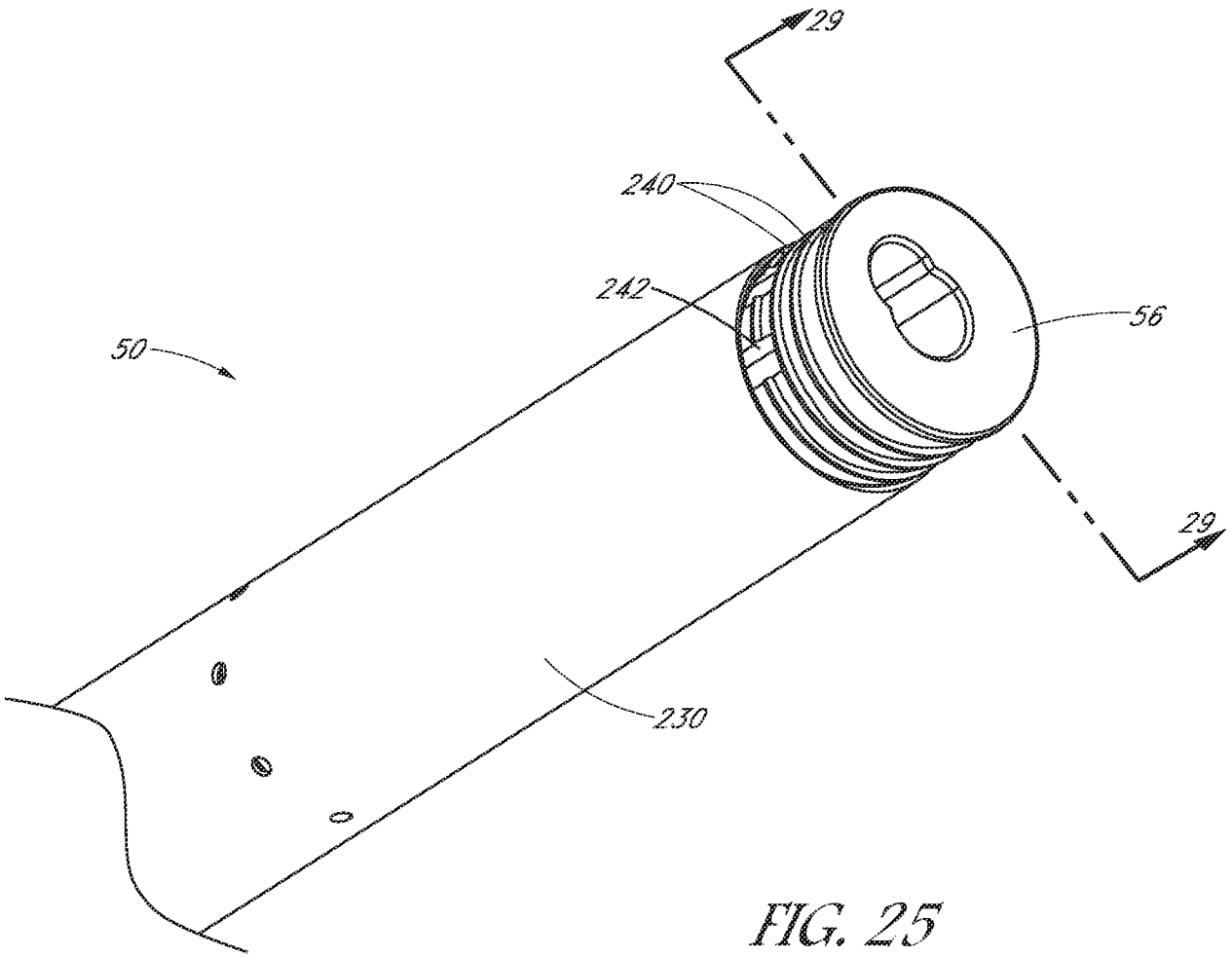
FIG. 25 shows the personal vaporizer of FIG. 21 depicted in a filling configuration.
Figure 26:
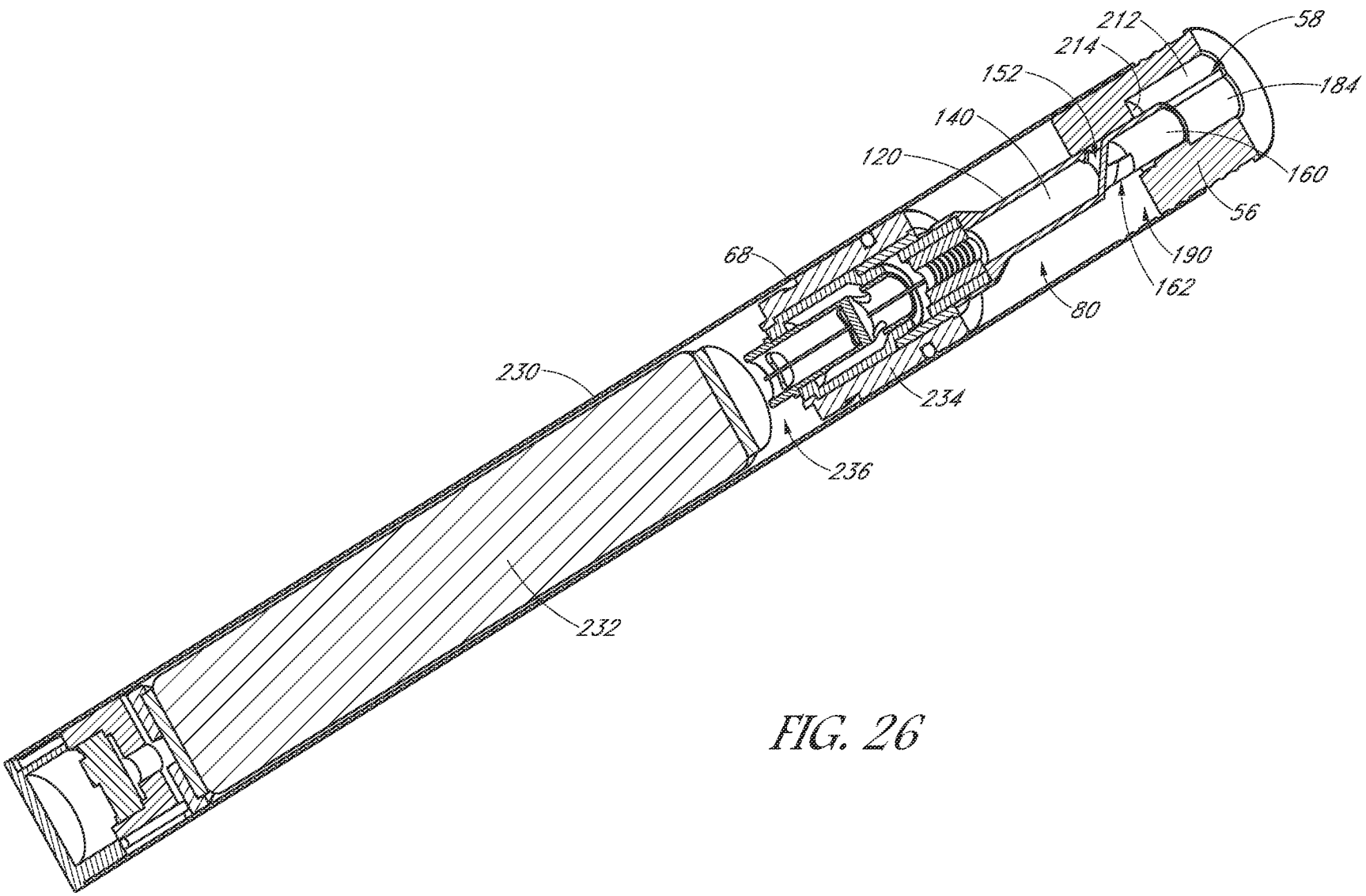
FIG. 26 is a cross-sectional view taken along line 26-26 of FIG. 25.
Figure 27:
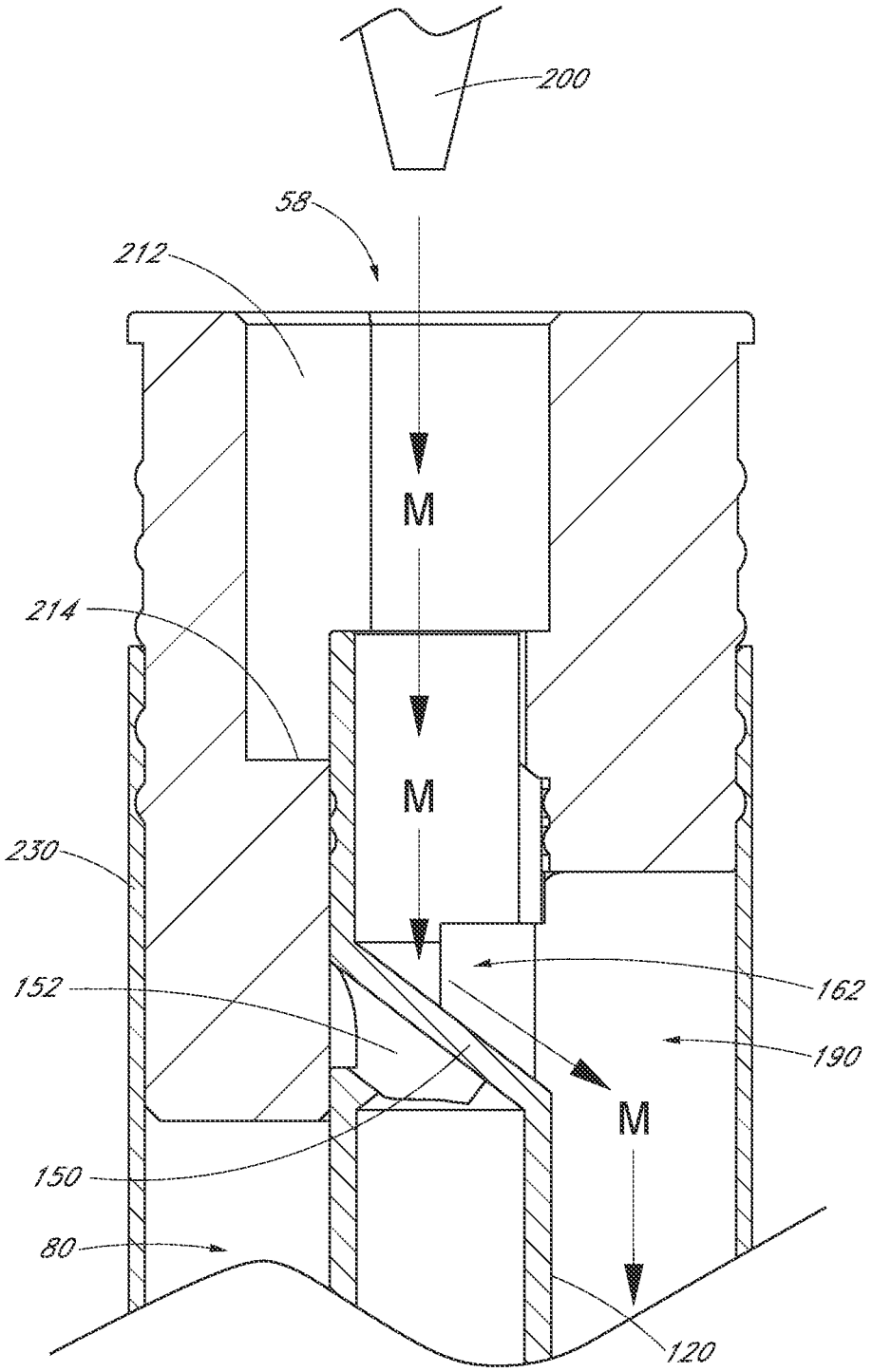
FIG. 27 is a partial view of the arrangement of FIG. 26, depicted during filling.

With specific reference next to FIGS. 25-27, the vaporizer 50 is depicted with the mouthpiece 56 partially inserted into the proximal end of the outer casing 230 and in a first position, or filling position. Notably, when in the filling position, a portion of the mouthpiece 56 extends through the proximal end of the casing 230. Also, the key ridge 210 has been slidably received in the key slot 208 so that the mouthpiece 56 is properly aligned relative to the center post 120. In this configuration, the first side opening 162 of the center post 120 is aligned with the filling space 190 of the mouthpiece 56. The bottom end of the vapor space 212 is proximal of the second side opening 152 so that the aperture engagement surface 176 blocks and seals the second side opening 152. Also, preferably the proximal ends of the vent slots 242 are disposed proximal of the proximal opening of the outer casing 230. As such, the vent slots 242 define venting pathways from the tank space 80 to the open atmosphere when the mouthpiece 56 is in the first position. A filling needle 200 can inject liquid media through the mouthpiece opening 58, and such media will flow through the filling path 160 of the center post 120, through the first side opening 162 and into the tank space 80, while the second side opening 152, or vapor opening, is blocked off. As media enters the tank space 80, potentially at high volumetric speed, air within the tank space 80 can vent to the atmosphere through the vent slots 242.

Figure 22:
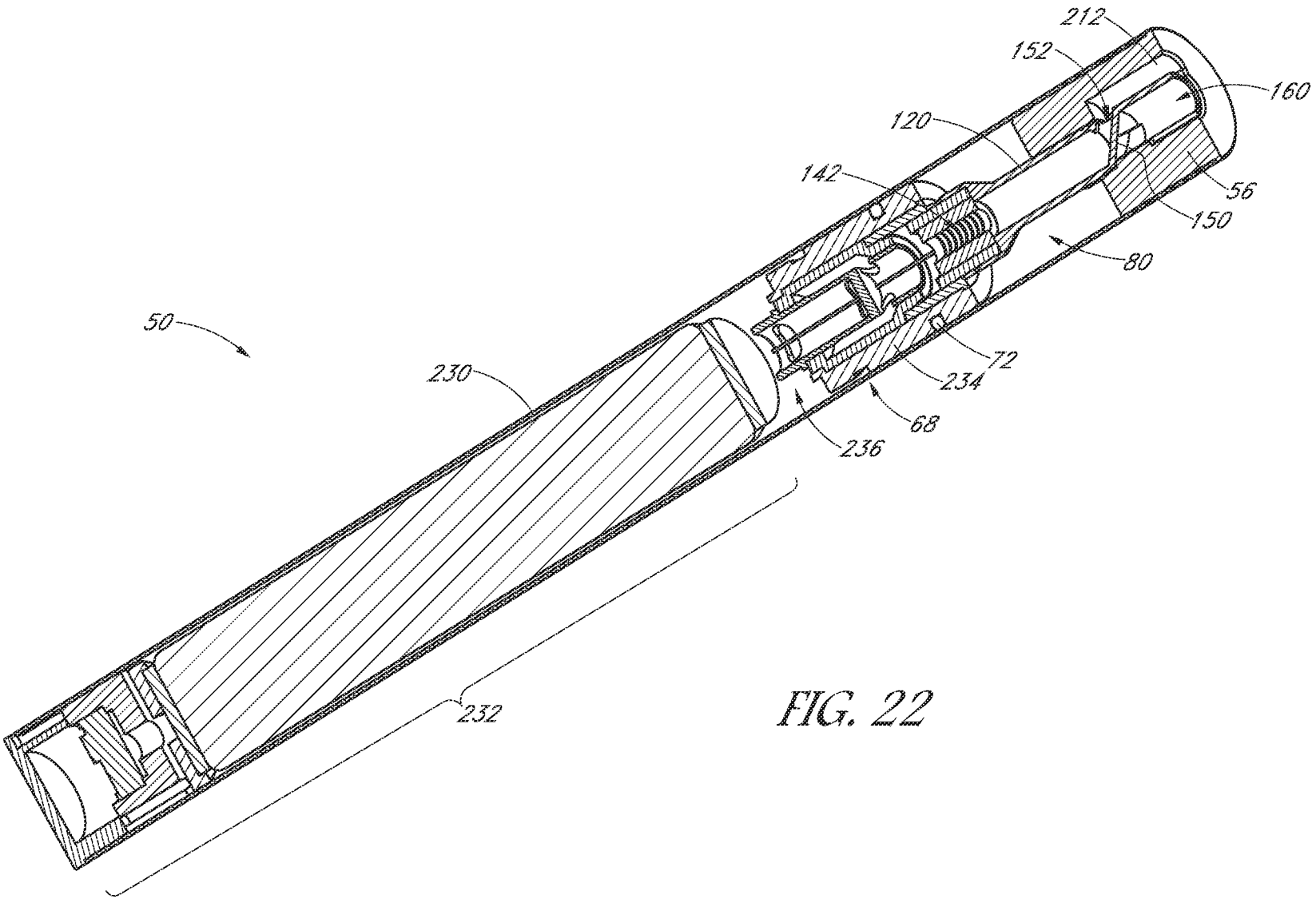
FIG. 22 is a cross-sectional view taken along line 22-22 of FIG. 21.
Figure 28:
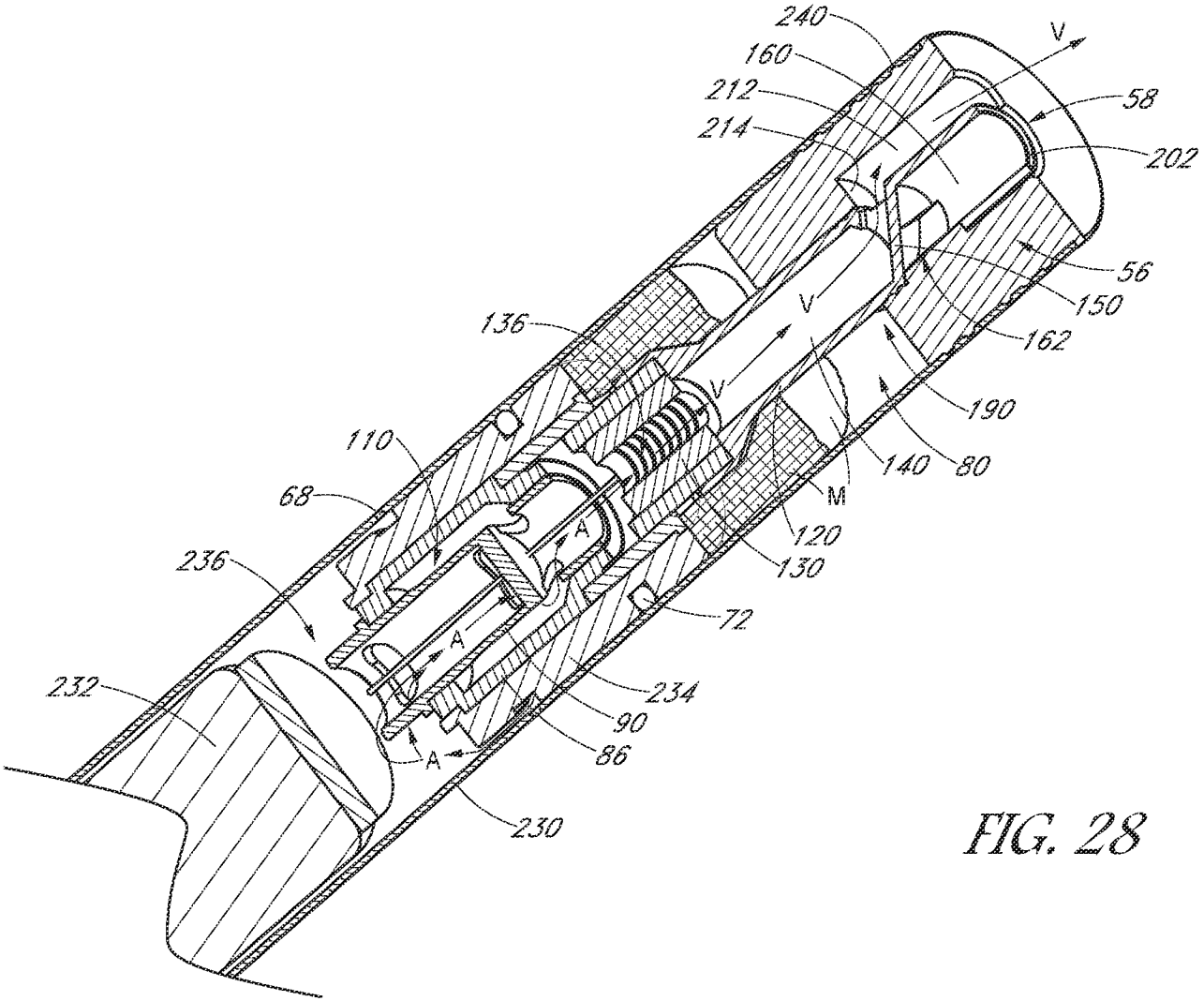
FIG. 28 depicts the arrangement of FIG. 22 during use.

With reference next to FIGS. 28 and 22, once the tank 60 is filled, the mouthpiece 56 can be pushed distally relative to the outer casing 230 and center post 120 to a second position at which a proximal flange of the mouthpiece 56 engages the proximal end of the outer casing 230. In this fully assembled configuration the center aperture 175 engagement surface 176 will block and seal the first side opening 162 of the center post 120, and the bottom end wall 214 of the vapor space 212 will be distal of the second side opening 152, or vapor opening, of the center post 120, while the engagement surface 176 sealingly engages the center post 120 distal of the first and second side openings and the sealing structures 240 engage and create a seal with the inner surface of the casing 230. As such, media M within the tank 60 is blocked from flowing into either of the first and second side openings 162, 152 or between the mouthpiece 56 and the casing 230, and vapor V from the vaporizing chamber 136 can flow proximally through the vapor tube 140 and second side opening 152 into the vapor space 212, and further to and through the mouthpiece opening 58.

The embodiments discussed herein have served as context for discussing inventive aspects. However, it is to be understood that the inventive aspects disclosed herein are not limited to the contextual structure, and can be employed in embodiments having differing basic structure. For example, each of the illustrated embodiments have employed a hollow center post 120 defining both a vapor tube 140 and a filling path 160. In additional embodiments, a hollow post extending proximally from the atomizer 142 through the tank space 80 to the mouthpiece 56, and defining both a vapor tube 140 and a filling path 160, may not be aligned with the axis of the vaporizer 50, but may be radially spaced from such axis. Also, additional embodiments may employ different structures to define the vapor tube 140 and filling passage. For example, the vapor tube 140 may extend uninterrupted from the atomizer 142 to its proximal end, and the filling passage may be defined by another tube and/or solely within the mouthpiece 56. Further, in the above-discussed embodiments, the mouthpiece 56 is moved from the first position to the second position by pushing it distally over the hollow center post 120. In additional embodiments, the mouthpiece 56 can be moved from a first position—in which communication between the mouthpiece 56 and the vapor tube 140 is blocked but communication between the mouthpiece 56 and the tank space 80 is open—to a second position—in which communication between the mouthpiece 56 and the tank space 80 is blocked but communication between the mouthpiece 56 and the vapor tube 140 is open—by other movements, such as rotation about the vaporizer axis. Indeed, several different structural approaches can be employed as desired.

Figure 29:
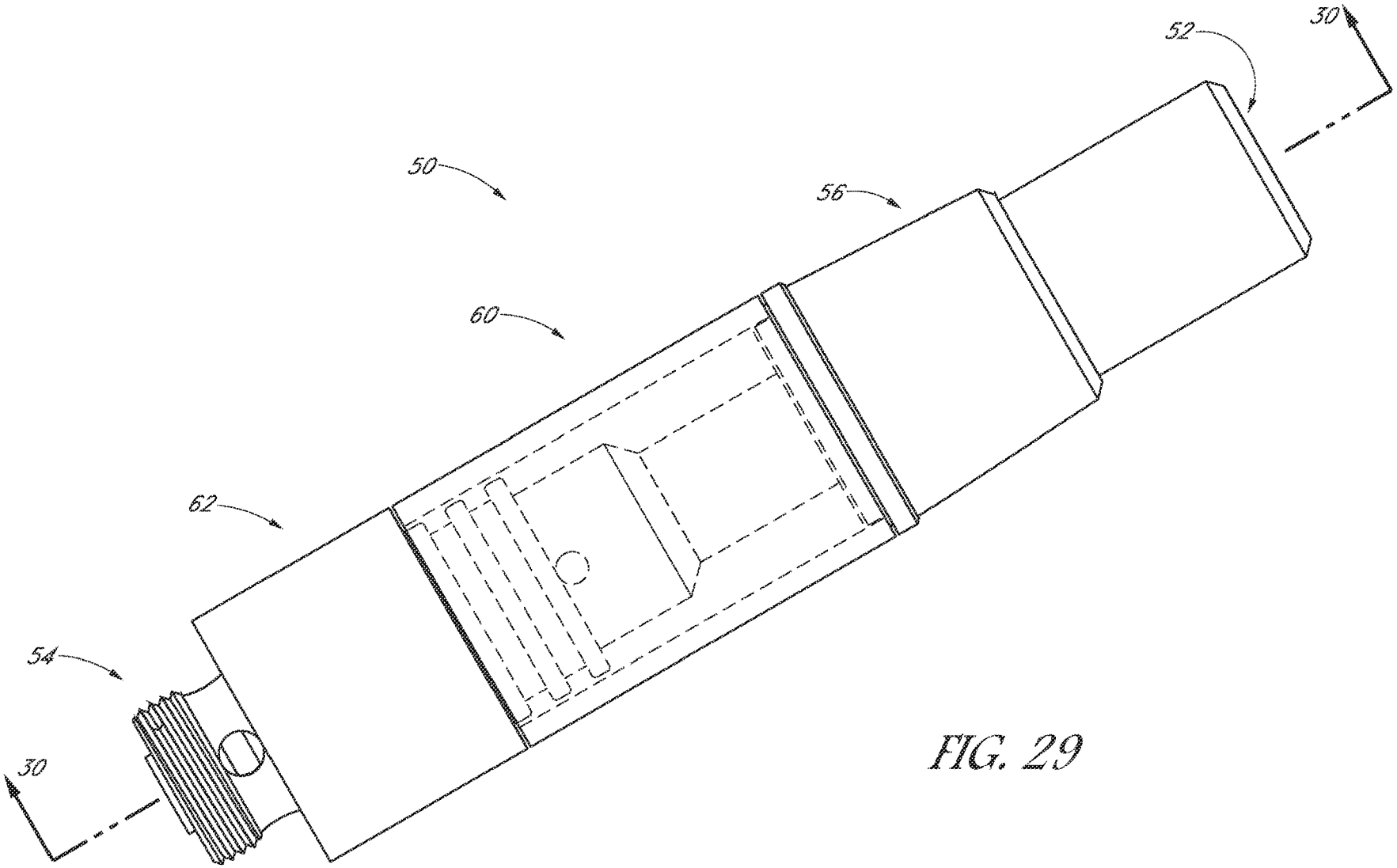
FIG. 29 is a perspective view of another embodiment of a personal vaporizer.
Figure 30:
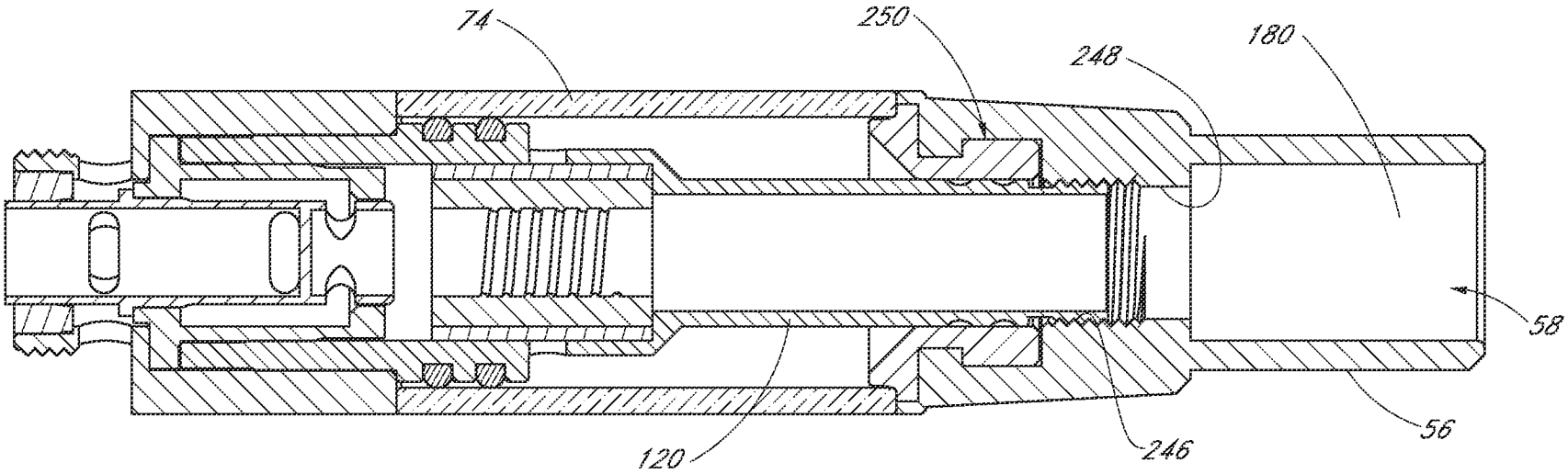
FIG. 30 is a cross-sectional view taken along line 30-30 of FIG. 29.
Figure 31:
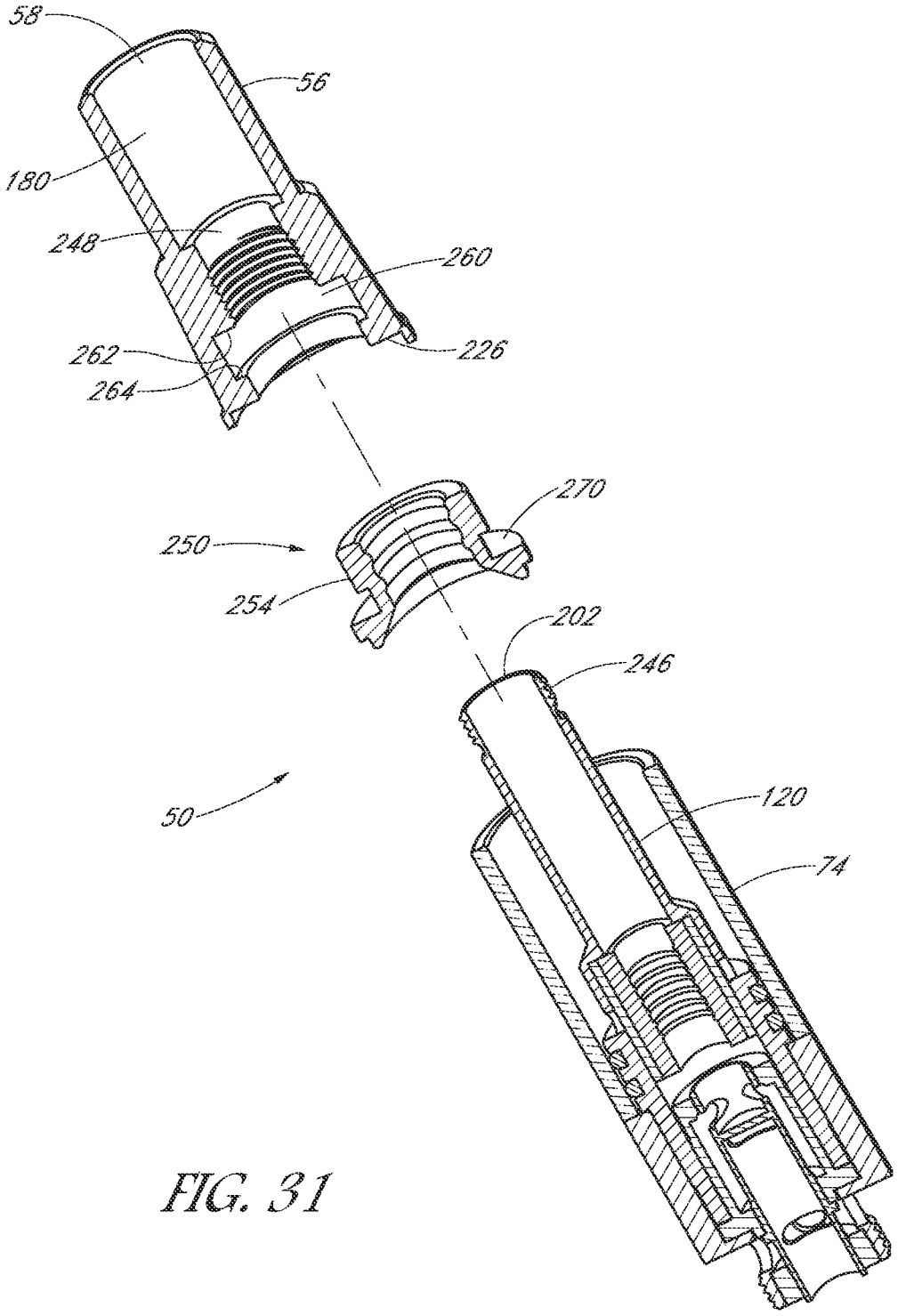
FIG. 31 is an exploded view of the arrangement of FIG. 30.

With reference next to FIGS. 29-31, another embodiment of a personal vaporizer 50 is shown. In the illustrated embodiment, the center post 120 defines a vapor tube 140 along its entire length, and comprises a mouthpiece attachment zone comprising outer threads 246 extending distally from its proximal end. The mouthpiece 56 comprises a post lumen 248 distal of a proximal lumen 180. The post lumen 248 preferably is sized to accommodate the proximal end of the center post 120 extending therethrough, and preferably at least a portion of the post lumen 248 comprises internal threads configured so as to threadingly engage the post outer threads 246 in order to connect the mouthpiece 56 to the center post 120.

Figure 32:
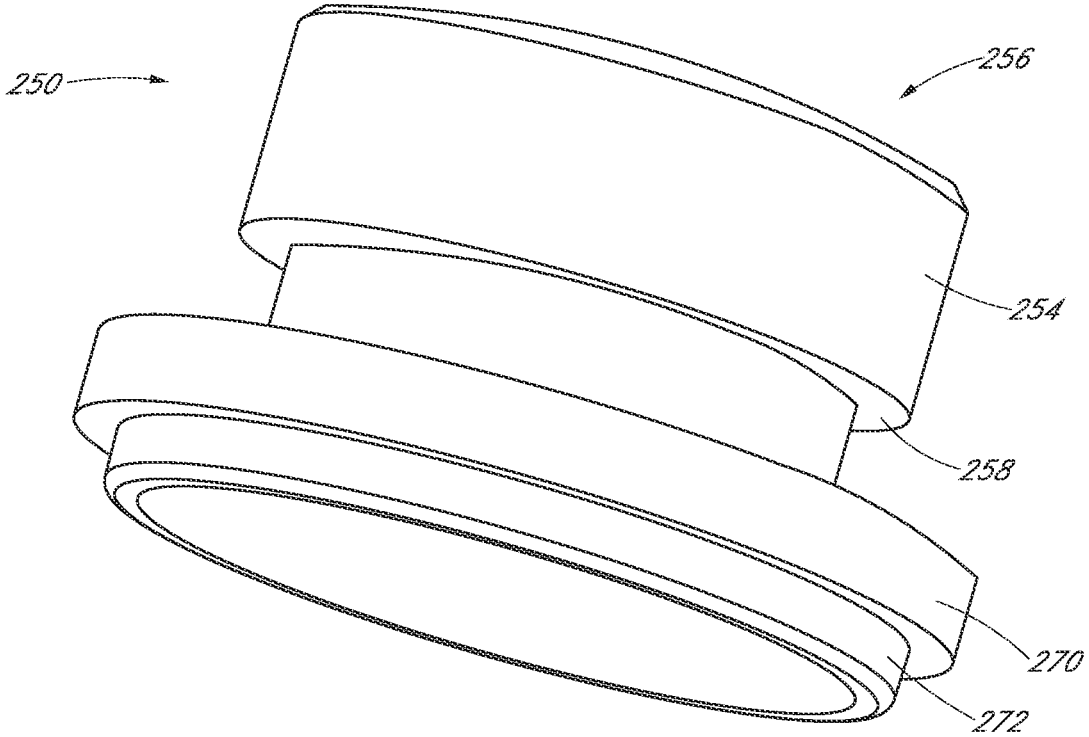
FIG. 32 is a perspective view of a mouthpiece seal in accordance with one embodiment.
Figure 33:
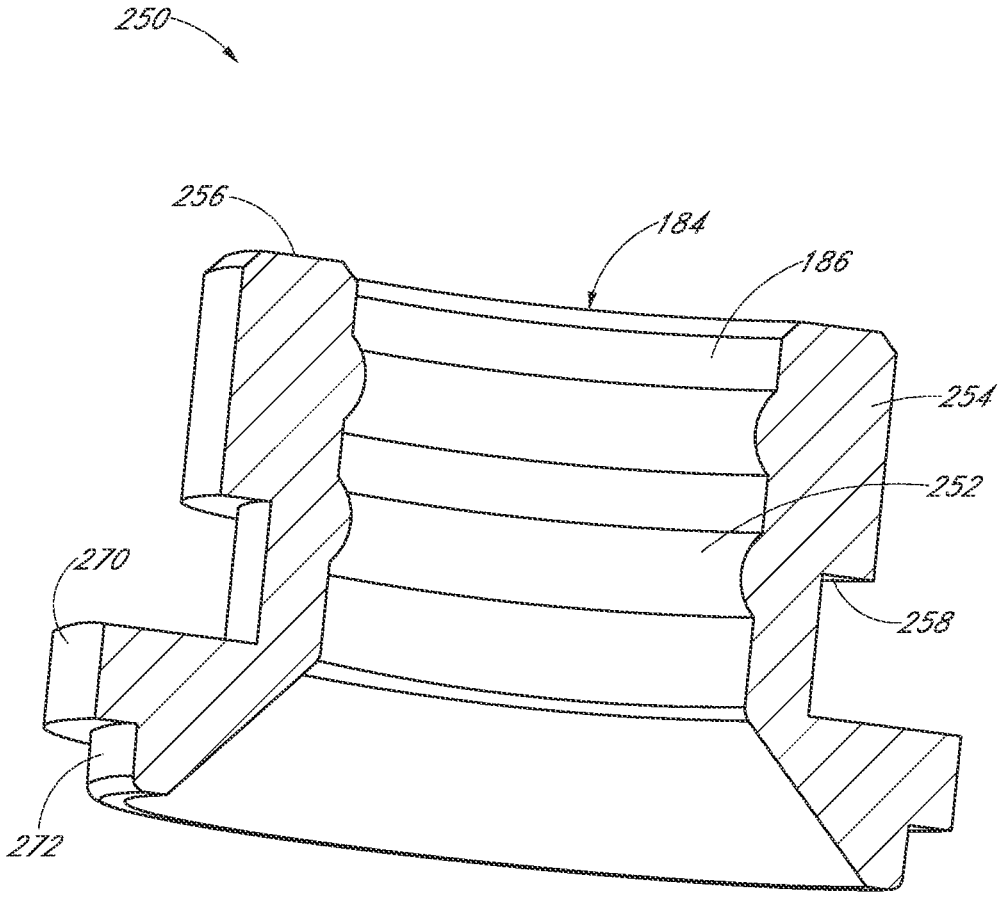
FIG. 33 is a cross-sectional view taken along line 33-33 of FIG. 32.

With additional reference to FIGS. 32 and 33, a mouthpiece seal 250 is configured to be sandwiched between the mouthpiece top and the tank wall 74 proximal end. As discussed in more detail below, the mouthpiece seal 250 preferably is a single, unitarily-formed elastomeric member configured to simultaneously effect a seal between the proximal end of the tank wall 74 and the mouthpiece 56 and between the center post 120 and the mouthpiece 56. Thus, a single mouthpiece seal 250 creates all the necessary sealing structure between the mouthpiece 56 and the rest of the personal vaporizer 50.

In the illustrated embodiment, the mouthpiece seal 250 extends from a proximal end to a distal end, and defines a center aperture 175 extending longitudinally therethrough. The center aperture 175 is sized to accommodate the center post 120 extending therethrough. An engagement surface 176 of the center aperture 175 preferably is configured to sealingly engage the outer wall of the center post 120. In some embodiments, including the illustrated embodiment, raised sealing structures 242 can extend from the engagement surface 176. The raised sealing structures 242 are configured to be at least partially compressed when the mouthpiece seal 250 is advanced over a center post 120, thus enhancing the seal between the mouthpiece seal 250 and the center post 120. In this embodiment, the seal created between the raised sealing structures 252/engagement surface 176 and the center post outer wall can be referred to as an inner seal. It is to be understood that, in additional embodiments, the center aperture 175 can be configured differently than in the illustrated embodiment, with other arrangements of specific structure being employed to create an inner seal between the center post 120 and the mouthpiece seal 250.

In the illustrated embodiment, the mouthpiece 56 and mouthpiece seal 250 are configured so that the mouthpiece seal 250 can be received into the mouthpiece 56 and attached thereto so that the mouthpiece 56 and mouthpiece seal 250 move together as a unit. A lock flange 254 of the mouthpiece seal 250 extends radially outwardly and extends from a proximal wall 256 of the mouthpiece seal 250 to a distal offset wall 258. A lock flange receiver 260 is formed in the mouthpiece 56, comprising a zone of relatively-increased inner diameter extending from a proximal wall 262 to a distal wall 264. Preferably, the lock flange receiver 260 is sized and configured to be complementary to the lock flange 254 so that the lock flange 254 can be received into the lock flange receiver 260 and, once so received, the lock flange 254 will not easily pull out of the lock flange receiver 260. As such, the mouthpiece seal 250 will be attached to the mouthpiece 56.

Additionally, with the mouthpiece seal 250 attached to the mouthpiece 56, the proximal wall of the mouthpiece seal 250 will abut the proximal wall of the mouthpiece 56. In some embodiments it is not important to create a strong seal between the mouthpiece 56 and mouthpiece seal 250. However, in other embodiments, engagement between the proximal wall of the mouthpiece seal 250 and the proximal wall of the mouthpiece is configured to effect a proximal seal. Notably, other surfaces of the mouthpiece seal 250 in contact with the mouthpiece 56 can enhance such a proximal seal. In further embodiments, raised sealing structures (not shown) can even be provided, such as between the lock flange and the outer, circumferential surface of the lock flange receiver.

With continued reference to FIGS. 29-33, a distal flange 270 extends radially outwardly about the circumference of the mouthpiece seal 250 near the distal end of the seal. The distal flange 270 has a distal surface that intersects with a distal annular surface 272. The distal annular surface 272 extends distally from the distal surface of the distal flange 270 to the distal end of the mouthpiece seal 250. Together, the distal flange surface 270 and distal annular surface 272 define a distal sealing surface configured to engage the proximal end of the tank wall 74 so that the distal flange 270 distal surface engages the tank wall 74 proximal surface and the distal annular surface 272 engages the inner surface of the tank wall 74 adjacent the proximal end. Such engagement defines a distal seal with the tank wall 74.

During assembly of the personal vaporizer 50, the mouthpiece seal 250 preferably is attached to the mouthpiece 56, and the assembly preferably is advanced distally over the center post 120 so that the mouthpiece inner threads engage the center post outer threads 246. The mouthpiece 56 is then threadingly advanced over the center post 120 until the distal seal engages, and preferably is compressed against, the proximal end of the tank wall 74. As such, the mouthpiece seal 250 is sandwiched between the mouthpiece 56 and the tank wall 74, and vaporization media in the tank 60 is prevented from leaking both between the tank wall 74 and mouthpiece 56 (due to the distal seal) and between the mouthpiece 56 and the center post 120 (due to the inner seal).

It is to be understood that, in additional embodiments, different specific structures can be employed. For example, in some embodiments the distal seal may not employ one of the illustrated distal annular surface or the distal surface of the distal flange, and/or the distal annular surface may employ one or more raised sealing structures. Also, in additional embodiments the distal annular surface may extend distally a distance from the distal end of the distal flange, but not all the way to the distal end. Instead, a portion of the mouthpiece seal 250 distal of the distal annular surface can have a reduced diameter that is not configured to engage the inner surface of the tank wall 74.

Additionally, in some embodiments the mouthpiece seal 250 may dispense with structure (such as the lock flange) that attaches the mouthpiece seal 250 to the mouthpiece 56 so that they move together as a unit. In such embodiments, the mouthpiece seal 250 may still be held securely between the mouthpiece 56 and the tank wall 74 because the mouthpiece 56 is connected to the center post 120 in a manner so that the mouthpiece seal 250 is sandwiched between the mouthpiece 56 and the tank wall 74 so as to compress the mouthpiece seal 250 somewhat. Also, although the illustrated embodiment shows the center post 120 and mouthpiece 56 as being threadingly connected, it is anticipated that other structures can be used to connect the mouthpiece 56 to the center post 120—both releasably and permanently. For example, a J-lock, ball-and-spring detent, press-fit or other structure can be employed.

Figure 34:
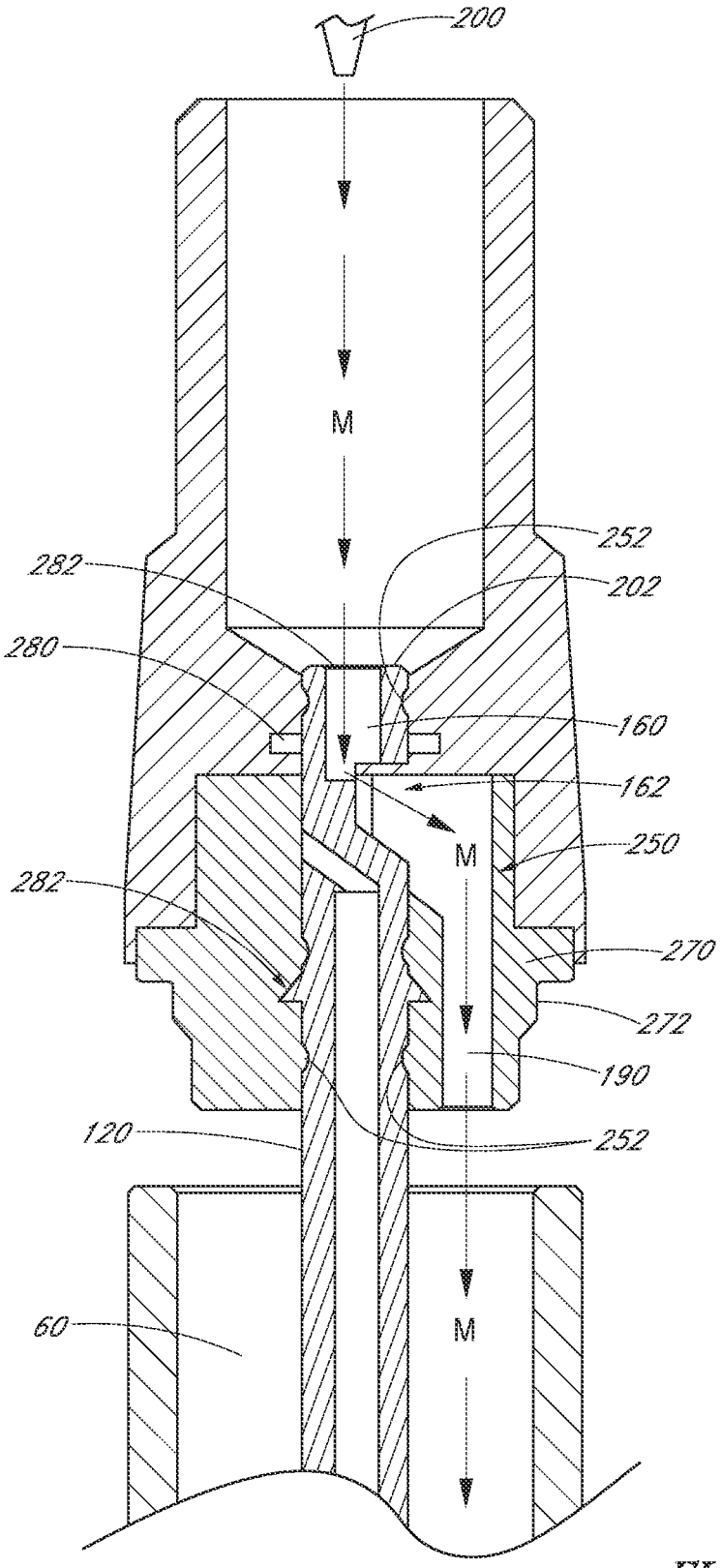
FIG. 34 is a partial cross-sectional view of another embodiment of a personal vaporizer, depicted in a filling configuration and during filling.
Figure 35:
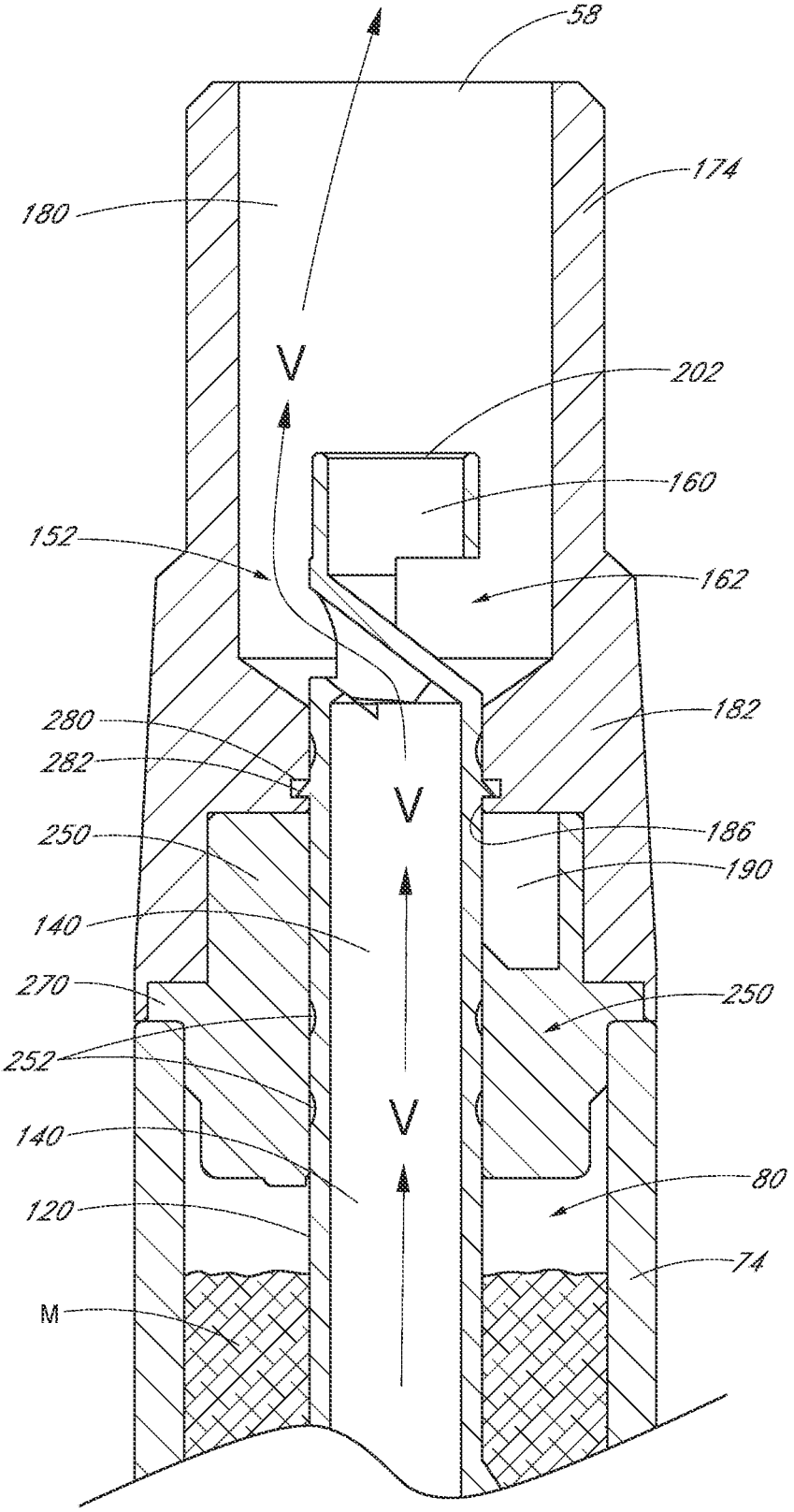
FIG. 35 shows the personal vaporizer of FIG. 34 fully assembled and during use.
Figure 36:
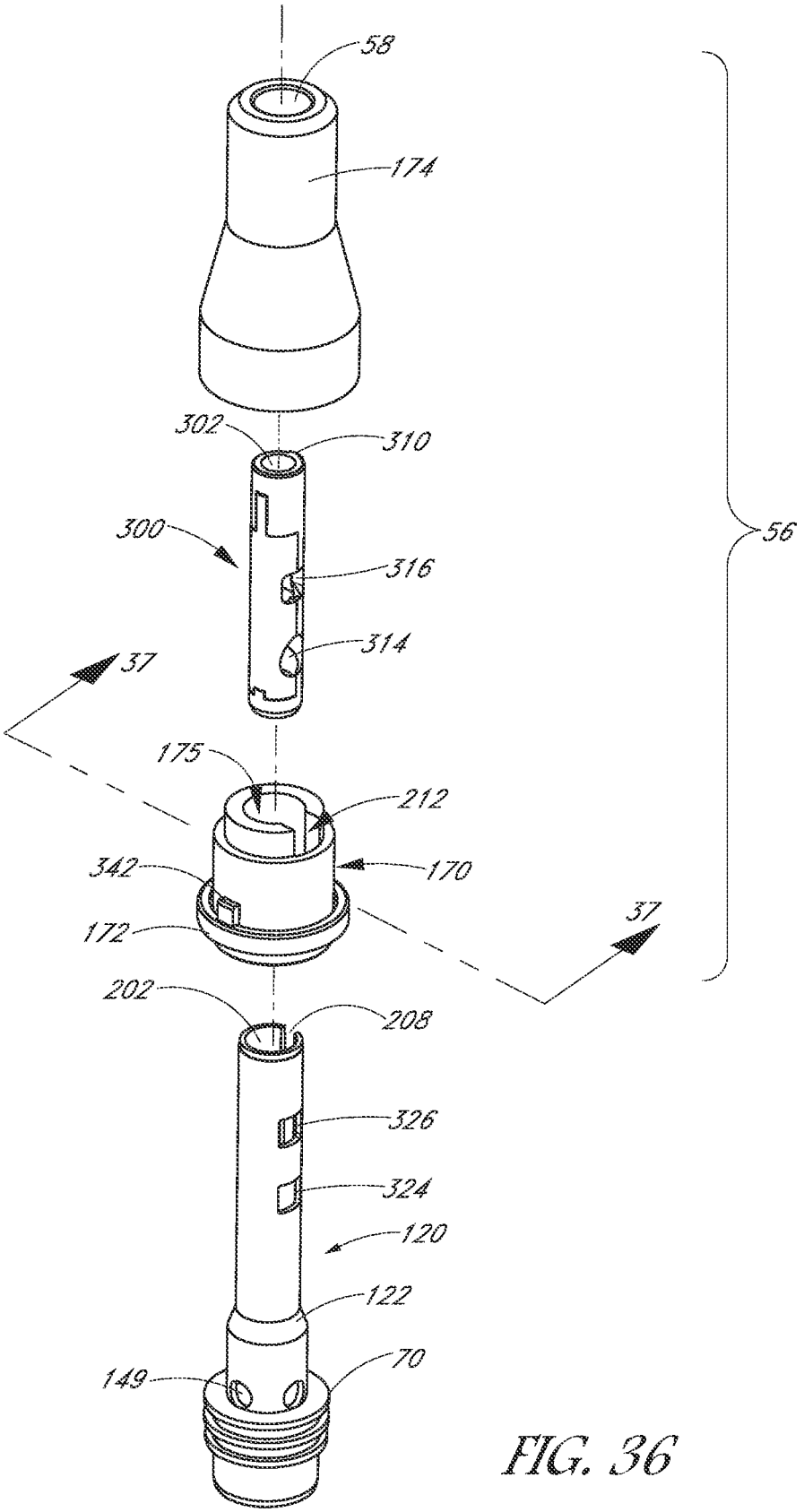
FIG. 36 is an exploded perspective view of portions of another embodiment of a personal vaporizer.
Figure 37:
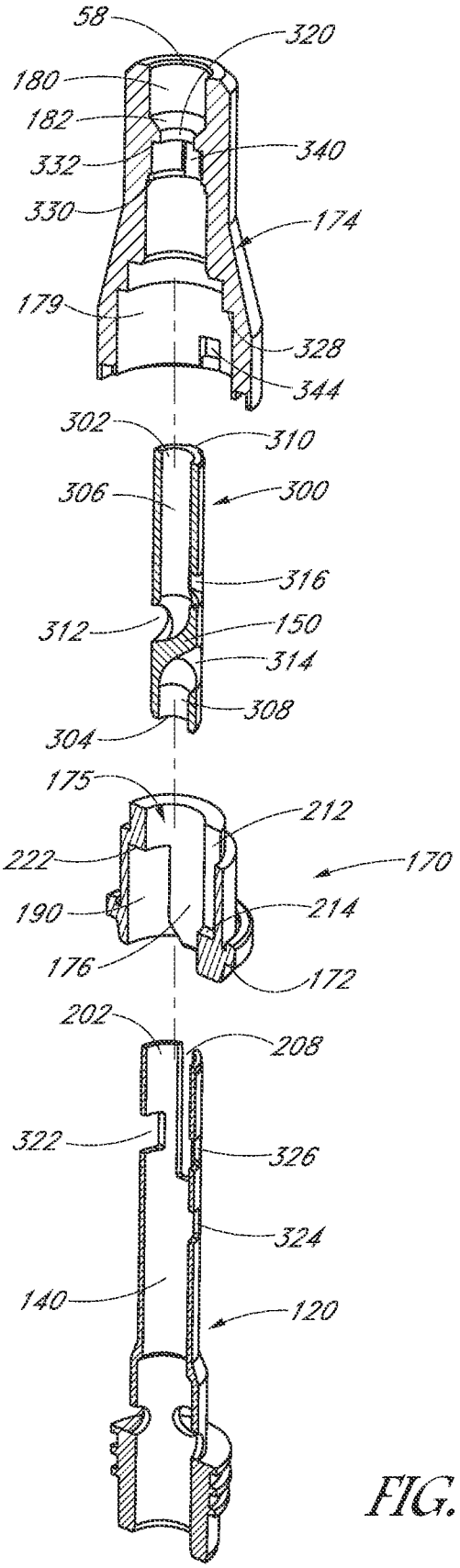
FIG. 37 is a cross-sectional view taken along line 37-37 of FIG. 36.

In the illustrated embodiments, the mouthpiece seal 250 has been used in conjunction with embodiments in which the center post 120 defines a vapor tube 140 that extends all the way to the proximal opening of the post. It is to be understood, however, that inventive aspects discussed herein can be employed in other configurations, such as those in FIGS. 1-28 in which the center post 120 includes a divider wall 150 dividing the center post 120 into the fill path extending from the proximal opening to the first side opening 162, and the vapor tube 140, which extends from the vaporizing chamber to the second side opening 152. For example, FIGS. 34 and 35 illustrate an embodiment like that of FIGS. 8 & 9, but modified to incorporate features as discussed in connection with FIGS. 29-33. In FIGS. 34 and 35, a unitarily-formed mouthpiece seal 250 is configured to incorporate structure corresponding to previously-described embodiments of the insert 170 and seal, while also incorporating structure of the mouthpiece seal 250 depicted in FIGS. 32 and 33, such as raised sealing structures 242. The filling space 190 and associated structure is also preferably formed within the unitarily-formed mouthpiece seal 250. It is to be understood that a mouthpiece seal can be configured in various ways, such as consistent with other embodiments discussed above, thus enabling filling of the tank 60 when at a first position, and sealing of the tank 60 while enabling use of the vaporizer 50 when in the second, fully-assembled position.

FIGS. 34 and 35 also show another embodiment of a connection structure in which a circumferential receiver slot 280 is formed in an inner surface of the blocking structure 182 of the mouthpiece 56. A circumferential post lock flange 282 extends radially outwardly from the center post 120. In a preferred embodiment, a proximal surface of the post lock flange 282 is inclined relative to the vaporizer axis, while a distal surface of the post lock flange 282 is normal to the axis. When the mouthpiece 56 and mouthpiece seal 250 are advanced distally over the center post 120, the mouthpiece seal 250 can deform to pass over the post lock flange 282 due to the inclined proximal surface and elastomeric properties of the mouthpiece seal 250, as can at least a portion of the mouthpiece blocking structure 182. However, once the post lock flange 282 is received in the lock receiver 280, as shown in FIG. 34, the normal distal surface of the post lock flange 282 engages a similarly-configured surface of the lock receiver 280, blocking the mouthpiece 56 from moving proximally relative to the center post 120. In additional embodiments, the distal surface of the post lock flange 282 can also be inclined, as can the distal wall of the lock receiver 280, so as to even more securely secure the post lock flange 282 into the lock receiver 280. As such, the mouthpiece seal 250 is sandwiched between the mouthpiece 56 and the proximal end of the tank 60, and preferably compressed somewhat.

In yet additional embodiments, the mouthpiece seal 250 can include a lock receiver structure similar to that in the mouthpiece 56 of FIGS. 34 and 35, while the center post 120 may include another post lock flange positioned to line up with the mouthpiece seal's lock receiver when the mouthpiece 56 is in the second position. As such, the mouthpiece seal can be attached to the center post 120 to block movement of the mouthpiece seal proximally relative to the center post 120 once the post lock flange and lock receiver are engaged. In additional embodiments, the mouthpiece seal 250 can employ structure (such as the lock flange depicted in FIGS. 29-33) that will complementarily fit within a corresponding lock flange receiver formed in the mouthpiece 56 so as to attach the mouthpiece seal 250 to the mouthpiece 56.

FIGS. 36-39 illustrate another embodiment of a personal vaporizer 50. In this embodiment, the hollow tube, or center post 120, is configured so that the vapor tube 140 extends uninterrupted from the element receiver 124 to the proximal opening 202. An elongated key slot 208 extends longitudinally and distally from the proximal opening 202. The mouthpiece assembly 56 includes a slide valve 300 that is configured to fit within the vapor tube 140. The slide valve 300 is elongated and tubular, extending from a proximal opening 302 to a distal opening 304. A divider wall 150 divides the tubular valve 300 into a proximal lumen 306 and a distal lumen 308. A key 310 comprises an elongated ridge extending radially outwardly along the length of the valve 300. The key 310 is configured to fit within the key slot 208 of the center post 120 so that the valve 300 is maintained at a desired orientation within the vapor tube 140 when sliding within the center post 120.

A valve fill opening 312 is formed through a side of the valve 300 and communicates with the proximal lumen 306, most preferably at a distal end of the proximal lumen 306. A distal valve vapor opening 314 is formed through the side of the valve 300, preferably on an opposite side of the valve from the valve fill opening 312, and communicates with the distal lumen 308. Preferably, the distal valve vapor opening 314 is aligned with a proximal end of the distal lumen 308. A proximal valve vapor opening 316 is formed through the side wall of the valve 300 so as to communicate with the proximal lumen 306. The proximal valve vapor opening 316 is offset longitudinally from the valve fill opening 312, and preferably is proximal of the valve fill opening 312.

A tube fill opening 322, tube distal vapor opening 324 and tube proximal vapor opening 326 are formed through the center post and communicating with the vapor tube 140. Preferably, the tube fill opening 322, tube distal vapor opening 324 and tube proximal vapor opening 326 are sized to generally match respective ones of the valve fill opening 312, distal valve vapor opening 314 and proximal valve vapor opening 316. The tube distal and proximal vapor openings 324, 326 preferably are spaced similarly to the distal and proximal valve vapor openings 314, 316, but the tube fill opening 322 is positioned differently relative to the tube vapor openings 324, 326 than is the valve fill opening 312 position relative to the valve vapor openings 314, 316. As such, when the tube distal vapor opening 324 is aligned with the distal valve vapor opening 314, the tube proximal vapor opening 326 is also aligned with the proximal valve vapor opening 316, but the tube fill opening 322 is not aligned with the valve fill opening 312. Also, when the tube fill opening 322 is aligned with the valve fill opening 312, the tube distal and proximal vapor openings 324, 326 are not aligned with respective distal and proximal valve vapor openings 314, 316.

With continued reference to FIG. 36-39, the mouthpiece top 174 comprises a distal lumen 179 and a proximal outlet lumen 180 that are separated by a blocking structure 182. A proximal aperture 320 is formed through the blocking structure 182, connecting the distal lumen 179 to the proximal outlet lumen 180. The illustrated distal lumen 179 has a stepped structure in which the diameter of the distal lumen 179 progressively diminishes at a distal offset surface 328, a medial offset surface 330, and a proximal offset surface 332. A key slot 340 extends proximally from the medial offset surface 330 to the blocking structure 182. The key slot 340 is sized and configured complementary to the valve key 310 so as to slidably accept the valve key 310. As such, when the valve 300 is advanced proximally into the mouthpiece top 174, when properly aligned the valve key 310 will slide into the key slot 340 so that the proximal end of the valve 300 abuts the proximal offset surface 332 and the proximal opening 302 of the valve is aligned with the proximal aperture 320 of the mouthpiece top 174. If the valve 300 is not properly aligned with the mouthpiece top 174, the valve 300 will be blocked from being fully advanced proximally to abut the proximal offset surface 332.

Figure 39:
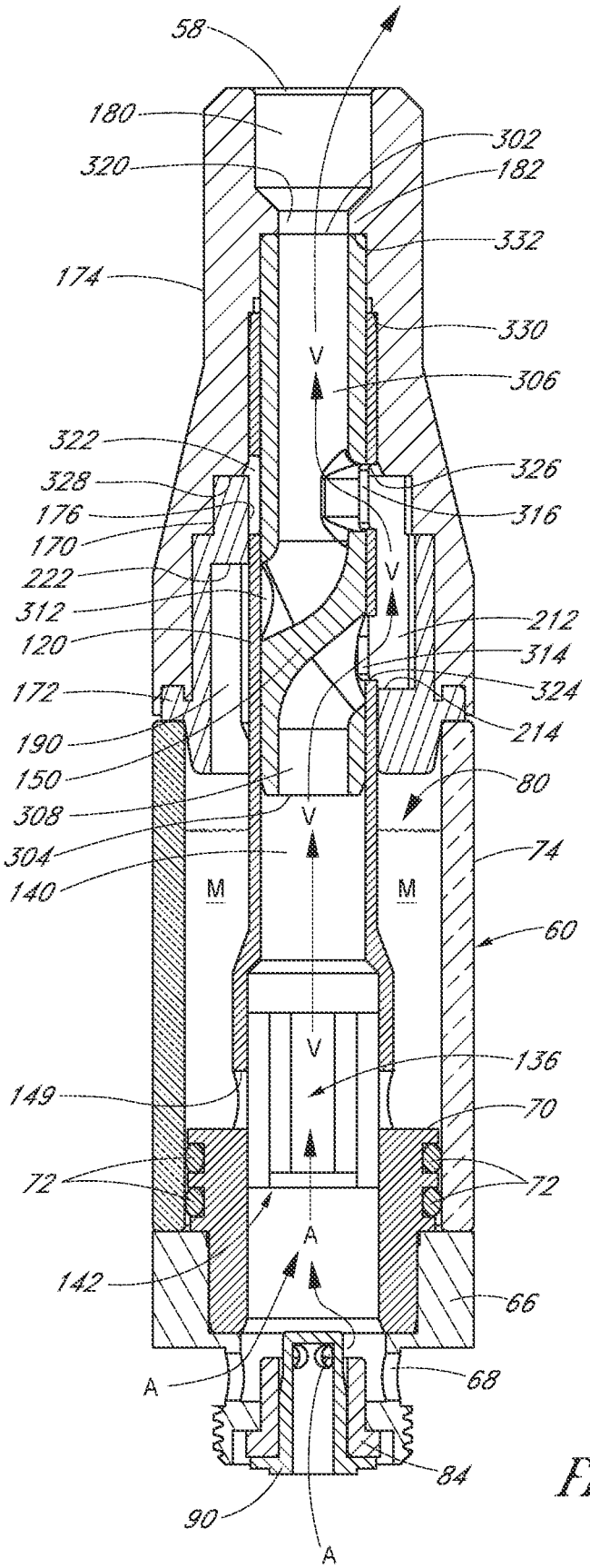
FIG. 39 shows the arrangement of FIG. 38 in a fully assembled configuration, depicted during use.

The insert 170 is elongated and has a distal portion configured to fit through a proximal end of the tank wall 74 and into the tank space 80. A circumferential seal 172 is, in the illustrated embodiment, unitarily formed with the insert 170, and is configured to create a seal between the tank 60 and mouthpiece top 174 when the vaporizer 40 is fully assembled as shown in FIG. 39. A center aperture 175 extends longitudinally through the insert 170 and is sized complementarily to the center post 120. An engagement surface 176 of the center aperture 175 is configured to sealingly engage the center post 120.

A vapor space 212 extends longitudinally from the proximal end of the insert 170 distally to a distal wall 214. The engagement surface 176 opens to the vapor space 212, which is offset radially from the axis of the insert 170. An elongated filling space 190 is also spaced radially from the center aperture 175 and communicates with the center aperture 175, but preferably on a side of the axis opposite the vapor space 212. The filling space 190 extends distally from a proximal end wall 222 to the distal end of the insert 170. In the illustrated embodiment, the proximal end wall 222 of the filling space 190 is proximal of the distal end wall 214 of the vapor space 212.

A pair of key ridges 342 (see FIG. 36) extend outwardly from opposite sides of a body of the insert 170 proximal of the seal 172. A corresponding pair of key receivers 344 (see FIG. 37) is formed in the inner surface at the distal end of the mouthpiece top 174. The key receivers 344 are configured to slidably receive the key ridges 342 of the insert 170 when the insert 170 is inserted into the distal lumen 179 of the mouthpiece top 174. When properly aligned—and only when properly aligned—the insert 170 can be slid into the distal lumen 179 so that the key ridges 342 are slidably received into the key receivers 344 and the proximal end of the insert 170 abuts the distal offset surface 328. Also, the valve fill opening 312 is aligned with the filling space 190 and the valve distal and proximal vapor openings 314, 316 are aligned with the vapor space 212.

In the illustrated embodiment, the mouthpiece assembly 56 is assembled by properly aligning and advancing the valve 300 and insert 170 into the mouthpiece top 174. Once properly assembled, the mouthpiece assembly 56 can be advanced over the center post 120. To do so, the valve key 310 is aligned with the key slot 208 so that the valve 300 can be slidably received and advanced within the vapor tube 140 of the center post 120.

Figure 38:
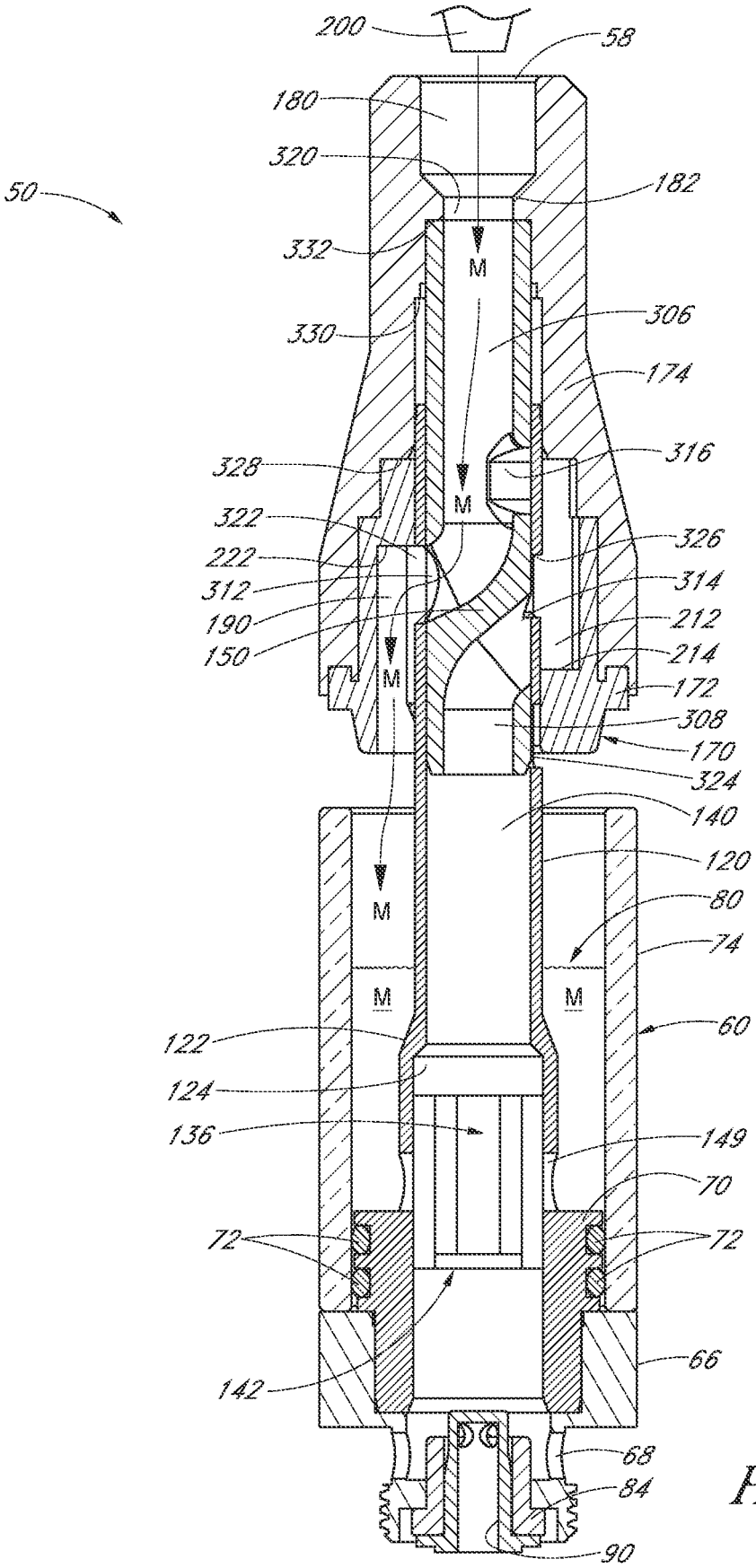
FIG. 38 is a cross-sectional view of another embodiment of a personal vaporizer incorporating the arrangement of FIG. 37, shown partially assembled in a filling configuration, depicted during filling.

Preferably, the mouthpiece assembly 56 is first advanced over the center post 120 to a first position, or filling position, as depicted in FIG. 38. In this position, the engagement surface 176 of the insert 170 sealingly engages the outer surface of the center post 120 and the valve fill opening 312 is aligned with the tube fill opening 322. As such, the proximal lumen 306 of the valve communicates with the vapor space 190 of the insert 170. As shown, the proximal valve vapor opening 316 is blocked by the center post wall from communicating with the vapor space 212.

Continuing with reference to FIG. 38, a filling needle 200 can be aligned with the mouthpiece opening 58 and inject liquid media M therethrough, which liquid media M will flow through the proximal aperture 320 and into the proximal lumen 306 of the valve 300. Such media is diverted by the dividing wall 150 through the aligned valve fill opening 312 and tube fill opening 322 and into the filling space 190, from which it is directed distally into the tank space 80 to fill the tank 60 with liquid media M. Most preferably, the vaporizer 50 is held vertically with its proximal end up during the filling process.

Once the tank 60 has been filled, the mouthpiece 56 can be pushed distally to a second position, or fully assembled configuration, as depicted in FIG. 39. In the fully assembled configuration the seal 172 engages the proximal end of the tank wall 74, and the valve 300 is positioned so that the valve distal vapor opening 314 and tube distal vapor opening 324 are aligned with one another and with the vapor space 212; and the valve proximal vapor opening 316 and tube proximal vapor opening 324 are aligned with one another and with the vapor space 212. The divider wall 150 is arranged between the tube distal vapor opening 324 and tube proximal vapor opening 326. The valve fill opening 312 is blocked by the center post wall from communicating with the fill space 190. As shown, in the assembled configuration, the proximal end of the center post 120 abuts the medial offset surface 330.

With continuing reference to FIG. 39, during use, a user can draw a breath through the mouthpiece opening 58 while powering the atomizer 142. Intake air A will be drawn into the vaporization chamber 136, where it mixes with atomized media to form a vapor V. The vapor V is drawn proximally along the vapor tube 140 into the valve distal lumen 308 and is diverted by the divider wall 150 through the aligned valve distal vapor opening 314 and tube distal vapor opening 324 into the vapor space 212. After continuing proximally within the vapor space 212, the vapor V is directed through the aligned tube proximal vapor opening 326 and valve proximal vapor opening 316 into the valve proximal lumen 306, which itself is at least partially within the vapor tube 140. The vapor V moves proximally through the proximal opening 320, proximal outlet lumen 180 and out of the mouthpiece outlet 56.

Other embodiments can employ aspects discussed in the above embodiments but arranged and constructed somewhat differently. For example, in one embodiment the valve can have only a side fill opening proximal of the divider wall. When the side fill opening is aligned with the tube fill opening of the center post, the vaporizer can be filled with media, which is diverted as discussed above. After filling, and during or after fully assembling the device, the valve divider wall can be perforated and/or removed. As such, vapor V can flow directly along the vapor tube from the vaporization chamber to the mouthpiece top. Another embodiment can be configured so that the valve can be removed after filling. In still another embodiment, the valve can be a removable structure having a proximal portion that extends out of the mouthpiece outlet 58 for the filling process, after which the valve can be removed.

The embodiments discussed above have disclosed structures with substantial specificity. This has provided a good context for disclosing and discussing inventive subject matter. However, it is to be understood that other embodiments may employ different specific structural shapes and interactions, some of which have been discussed above.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. For example, a unitarily-formed mouthpiece as in FIGS. 29-33 can be modified and used in any of the embodiments described in principle in FIGS. 1-28. Additionally, any of the embodiments can be reconfigured to use a valve extending into the vapor tube as depicted in FIGS. 36-39. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A personal vaporizer, comprising:

a tank configured to contain a liquid vaporizing media;

a hollow tube extending through the tank, the hollow tube defining a tube lumen, a tube fill opening formed through a side of the hollow tube;

an atomizer configured to atomize liquid vaporizing media from the tank and communicate atomized liquid vaporizing media to the tube lumen; and a mouthpiece assembly comprising a sealing surface configured to engage a surface of the hollow tube;

wherein the mouthpiece assembly is configured to be slidable relative to the hollow tube so that when the mouthpiece assembly is in a first position the tube lumen is in communication with the tank via the tube fill opening, and when the mouthpiece assembly is in a second position the sealing surface blocks the fill opening.

2. The personal vaporizer of claim 1, wherein a divider wall is disposed in the hollow tube distal of the fill opening when the mouthpiece assembly is in the first position.

3. The personal vaporizer of claim 2, wherein the mouthpiece assembly comprises a valve that is slidable within the hollow tube, the valve having a valve fill opening and comprising the divider wall distal of the valve fill opening.

4. The personal vaporizer of claim 3, wherein the valve fill opening is aligned with the tube fill opening when the mouthpiece assembly is in the first position.

5. The personal vaporizer of claim 4, wherein when the mouthpiece assembly is in the second position a side wall of the valve blocks the tube fill opening.

6. The personal vaporizer of claim 5, wherein the hollow tube comprises a distal tube vapor opening and a proximal tube vapor opening formed through the side of the hollow tube.

7. The personal vaporizer of claim 6, wherein the valve comprises a distal valve vapor opening and a proximal valve vapor opening, the divider wall being between the distal valve vapor opening and the proximal valve vapor opening.

8. The personal vaporizer of claim 7, wherein when the mouthpiece assembly is in the first position the distal and proximal valve vapor openings are not aligned with the distal or proximal tube vapor openings, and wherein when the mouthpiece assembly is in the second position the distal and proximal valve vapor openings are aligned with respective ones of the distal and proximal tube vapor openings.

9. The personal vaporizer of claim 8, wherein the mouthpiece assembly additionally comprises a vapor space that is sealingly separated from the tank, and wherein when the mouthpiece assembly is in the second position the distal and proximal valve vapor openings are in communication with the vapor space.

10. The personal vaporizer of claim 8, wherein the mouthpiece assembly additionally comprises a filling space that is open to the tank, and wherein when the mouthpiece assembly is in the first position the valve fill opening is in communication with the filling space.

11. The personal vaporizer of claim 10, wherein the mouthpiece assembly comprises a sealing structure having a lumen sized to accommodate the hollow tube interposed between the sealing structure and the valve, and wherein the filling space and vapor space are arranged in the sealing structure.

12. A method of filling a personal vaporizer with a liquid vaporizing media, comprising:

arranging a mouthpiece assembly onto a hollow tube of the personal vaporizer in a filling position in which a mouthpiece opening of the mouthpiece communicates with a proximal opening of the hollow tube, a filling hole formed through a side of the hollow tube is unblocked, and a divider wall is disposed in the hollow tube distal of the filling hole; and injecting the liquid vaporizing media into the mouthpiece opening so that the liquid vaporizing media flows in the hollow tube and is diverted by the dividing wall through the filling hole; and wherein the liquid vaporizing media flows distally from the filling hole into a tank of the vaporizer.

13. The method of claim 12, additionally comprising moving the mouthpiece assembly to a use position in which the filling hole is blocked from communicating with the tank.

14. The method of claim 13, additionally comprising perforating the divider wall.

15. The method of claim 13, additionally comprising removing the divider wall from the hollow tube.

16. The method of claim 13, wherein the mouthpiece assembly comprises a valve configured to be slidable within the hollow tube and comprising the divider wall and a valve fill opening proximal of the valve.

17. The method of claim 16, wherein the valve comprises a proximal valve vapor opening proximal of the divider wall and a distal valve vapor opening distal of the divider wall, and the hollow tube comprises a proximal tube vapor opening and a distal tube vapor opening, and wherein when the mouthpiece assembly is in the use position the proximal valve vapor opening is aligned with the proximal tube vapor opening and the distal valve vapor opening is aligned with the distal tube vapor opening.

18. The method of claim 17, wherein the mouthpiece assembly additionally defines a vapor space that communicates simultaneously with the distal tube vapor opening and the proximal tube vapor opening when the mouthpiece assembly is in the use position, the vapor space being sealingly separated from the tank, the distal valve vapor opening being in communication through the hollow tube with a vaporization chamber of the vaporizer.

19. The method of claim 13, comprising moving the mouthpiece assembly distally over the hollow tube from the filling position to the use position.

20. The method of claim 19, comprising engaging a mouthpiece seal with a proximal end of the tank when moving the mouthpiece assembly to the use position.

* * * * *